US007762091B2

(12) United States Patent
Jin et al.

(10) Patent No.: US 7,762,091 B2
(45) Date of Patent: Jul. 27, 2010

(54) APPARATUS FOR CONTROLLING THE CAPACITY OF AN AIR CONDITIONER AND CONTROL METHOD USING THE SAME

(75) Inventors: Dong Sik Jin, Cheonan-si (KR); Young Wan Kim, Cheonan-si (KR); Seok Kyun Kim, Cheonan-si (KR); Soon Gon Kim, Goyang-si (KR)

(73) Assignee: Winiamando Inc., Choongchungnam-do (KR)

( * ) Notice: Subject to any disclaimer, the term of this patent is extended or adjusted under 35 U.S.C. 154(b) by 1247 days.

(21) Appl. No.: 11/267,620

(22) Filed: Nov. 4, 2005

(65) Prior Publication Data

US 2006/0112705 A1 Jun. 1, 2006

(30) Foreign Application Priority Data

Nov. 4, 2004 (KR) ..... 10-2004-0089427
Dec. 31, 2004 (KR) ..... 10-2004-0117923
May 19, 2005 (KR) ..... 10-2005-0042178

(51) Int. Cl.
*F25B 7/00* (2006.01)
*F25B 41/00* (2006.01)
*F25B 49/00* (2006.01)

(52) U.S. Cl. ..... 62/175; 62/196.2; 62/196.3; 62/228.5; 62/510

(58) Field of Classification Search ..... 62/175, 62/196.2, 196.3, 228.1, 228.5, 510
See application file for complete search history.

(56) References Cited

U.S. PATENT DOCUMENTS 6,085,533 A * 7/2000 Kaido et al. ..... 62/196.2
6,453,691 B1 * 9/2002 Seo et al. ..... 62/228.5

FOREIGN PATENT DOCUMENTS

KR 1994-0008430 B1 9/1994
KR 10-0180594 B1 2/1998
KR 10-0180595 B1 2/1998

* cited by examiner

*Primary Examiner*—Marc E Norman
(74) *Attorney, Agent, or Firm*—John P. White; Cooper & Dunham LLP

(57) ABSTRACT

Disclosed herein is an apparatus for controlling the capacity of an air conditioner and a control method using the same. The capacity control apparatus is configured in such a fashion that a 3-way or 4-way direction-switching member and a low-pressure equalizing solenoid valve are provided at a refrigerant path of the air conditioner having a pair of first and second compressors, so that the compression capacity of the air conditioner is adjusted into three stages of 100%, 60%, and 40% using the first and second compressors, enabling easy variable-capacity operation. This has the effect of considerably reducing energy consumption and of preventing wear of the first and second compressors via a rapid compensation of a pressure unbalance between both the compressors. As a result, under any operating condition, it is possible to prevent a liquid backflow phenomenon from occurring when starting operation of the compressors, resulting in an improvement in the reliability and operation efficiency of the compressors.

25 Claims, 17 Drawing Sheets

APPARATUS FOR CONTROLLING THE CAPACITY OF AN AIR CONDITIONER AND CONTROL METHOD USING THE SAME

BACKGROUND OF THE INVENTION

1. Field of the Invention

The present invention relates to an air conditioner having two compressors, and more particularly to an apparatus for controlling the capacity of an air conditioner having a pair of first and second compressors, in which a 3-way or 4-way direction-switching member and a low-pressure equalizing solenoid valve are provided at a refrigerant path of the air conditioner so that the compression capacity of the air conditioner is adjusted into three stages of 100%, 60%, and 40% using the first and second compressors to enable easy variable-capacity operation, thereby considerably reducing energy consumption and preventing wear of the first and second compressors via rapid compensation of pressure imbalance between both compressors, and a control method using the same.

2. Description of the Related Art

Generally, an air conditioner comprises a compressor, a condenser, a capillary tube, and an evaporator. In operation, if the compressor compresses a gaseous refrigerant, the compressed high-pressure gaseous refrigerant is fed into the condenser to be liquefied therein. Subsequently, the condensed high-pressure liquid refrigerant is instantaneously vaporized in the evaporator (hereinafter, referred to as an indoor heat exchanger, more briefly, indoor unit) while passing through the capillary tube having a small diameter. While absorbing heat during vaporization, the refrigerant causes a drop in temperature to produce cool air, so that the cool air is discharged to a room for air conditioning.

The vaporized refrigerant, after that, passes through the compressor and the condenser, so that it discharges heat while being liquefied. In this way, the refrigerant is continuously used to carry out the above-described air conditioning operation.

FIG. 1 is a configuration diagram illustrating a conventional air conditioner having first and second compressors. FIG. 2 is a configuration diagram illustrating another conventional air conditioner having first and second compressors and first and second indoor units. FIG. 3 is a diagram illustrating a conventional capacity control method using first and second compressors.

Referring to FIG. 1, the conventional air conditioner comprises: first and second compressors 12 and 14 for compressing a gaseous refrigerant to obtain a high-temperature and high-pressure refrigerant; first and second discharge pipes 16 and 18 used to deliver the refrigerant compressed in the first and second compressors 12 and 14; first and second check valves 20 and 22 provided downstream of the first and second discharge pipes 16 and 18, respectively, to prevent backflow of the refrigerant; a condenser 24 for condensing the refrigerant, having passed through the first and second check valves 20 and 22, to obtain a low-temperature and high-pressure liquid refrigerant; an expansion valve 26 used to rapidly expand the refrigerant delivered from the condenser 24 to obtain a low-temperature and low-pressure refrigerant; an indoor unit 2 for transferring heat of indoor air to the low-temperature refrigerant having passed through the expansion valve 26 to produce cool air to be discharged into a room; and first and second suction pipes 4 and 6 used to diverge the refrigerant vaporized in the indoor unit 2. The first and second compressors 12 and 14 and the condenser 24 are mounted in an outdoor shell B, while the expansion valve 26 and the indoor unit 2 are mounted in an indoor shell A.

Assuming that the total compression capacity of the refrigerant is 100%, the first compressor 12 has a partial refrigerant compression capacity of 40%, and the second compressor 14 has a partial refrigerant compression capacity of 60%.

Now, the operation of the above-described conventional air conditioner having the single indoor unit will be explained. First, when a user initiates full-capacity operation of the air conditioner, both the first and second compressors 12 and 14 are simultaneously operated, so that the refrigerant, suctioned through both the first and second suction pipes 4 and 6, is compressed and discharged into the first and second discharge pipes 16 and 18.

Subsequently, the compressed refrigerant is delivered into the condenser 24 by way of the first and second check valves 20 and 22 provided at the first and second discharge pipes 16 and 18 without a backflow risk. Thereby, the refrigerant is liquefied in the condenser 24, and then, passes through the expansion valve 26 and the indoor unit 2, to supply cool air into a room.

On the other hand, when the air conditioner is operated in a power-saving mode, only one of the first and second compressors 12 and 14 is selectively operated, thereby supplying weakly cool air into a room.

Referring to FIG. 3 illustrating an automatic operation mode of the air conditioner, the above-described selective operation of both the compressors is controlled based on a temperature difference (DT) between room temperature and the set temperature of the air conditioner.

Since the temperature difference (DT) corresponds to a load capacity of the indoor unit 2, the following definition is obtained.

Load capacity of Indoor unit (*DT*)=Room Temperature (*RT*)−Set Temperature of Air Conditioner (*ST*)

If the temperature difference (DT) between the room temperature and the set temperature increases beyond a first preset value (DTS1), the full-load compression capacity of 100% is determined, causing both the first and second compressors 12 and 14 to be simultaneously operated. If the temperature difference (DT) falls between the first preset value (DTS1) and a second preset value (DTS2), a partial-load compression capacity of 60% is determined, causing only the second compressor 14 to be operated. Also, if the temperature difference (DT) falls between the second preset value (DTS2) and a third preset value (DTS3), a partial-load compression capacity of 40% is determined, causing only the first compressor 12 to be operated.

The control procedure as stated above minimizes the temperature difference (DT) between the room temperature and the set temperature of the air conditioner, keeping the room temperature (RT) at a desired appropriate value.

Referring to FIG. 2 illustrating another conventional air conditioner having first and second compressors and first and second indoor units, the configuration of FIG. 2 is substantially identical to that of FIG. 1 except for the use of first and second selector valves 8 and 10. The first selector valve 8 serves to selectively deliver the refrigerant condensed in the condenser 24 to the first indoor unit 2*a*, and the second selector valve 10 serves to selectively deliver the refrigerant condensed in the condenser 24 to the second indoor unit 2*b*. Here, the first indoor unit 2*a* is of a room air conditioner (RAC) type, and the second indoor unit 2*b* is of a package air conditioner (PAC) type.

For example, as the first indoor unit 2*a*, which is mounted in a bedroom, and the second indoor unit 2*b*, which is mounted in a living room, are selectively operated, the first and second compressors 12 and 14 are also able to be selectively operated in accordance with a given load capacity.

In this case, the expansion valve 26 of the RAC type first indoor unit 2*a* may be located upstream of the first selector valve 8.

When the air conditioner of FIG. 2 is operated in the automatic operation mode as shown in FIG. 3, the operation of the first and second compressors 12 and 14 is controlled in accordance with the load capacities of the first and second indoor units 2*a* and 2*b*.

Here, the load capacity (DT) of the first indoor unit 2*a* is defined as the room temperature (RT) minus the set temperature of the air conditioner (ST), and similarly, the load capacity of the second indoor unit 2*b* is defined as the room temperature (RT) minus the set temperature of the air conditioner (ST). Thus, the operation of the first and second compressors 12 and 14 is controlled in accordance with the total load capacity (DT) of the first and second indoor units 2*a* and 2*b*.

If the total load capacity (DT) increases beyond a first preset value (DTS1), the full-load compression capacity of 100% is determined, causing both the first and second compressors 12 and 14 to be simultaneously operated. If the total load capacity (DT) falls between the first preset value (DTS1) and a second preset value (DTS2), a partial-load compression capacity of 60% is determined, causing only the second compressor 14 to be operated. Also, if the total load capacity (DT) falls between the second preset value (DTS2), and a third preset value (DTS3), a partial-load compression capacity of 40% is determined causing only the first compressor 12 to be operated.

However, the multistage type air conditioners as stated above have a problem in that excess electricity is used to start operation of the first and second compressors 12 and 14. This results in significant degradation of energy consumption efficiency because of repetitive starting-operation/stop-operation of the compressors.

Also, the first and second discharge pipes 16 and 18 between the first and second compressors 12 and 14 and the first and second check valves 20 and 22 are affected by a high-pressure, whereas entrance ends of the first and second compressors 12 and 14 and the first and second suction pipes 2 and 6 are affected by a low-pressure. In such a pressure imbalance condition, it is very difficult to restart operation of the first and second compressors 12 and 14. Thus, there exists a need for a pressure equalizing time, and this prevents prompt operation of the compressors.

Furthermore, in the case of conventional air conditioners designed to achieve an increase in energy consumption efficiency via frequent repetitive starting-operation/stop-operation of the plurality of compressors, they inevitably confront a liquid backflow phenomenon due to a pressure difference caused during operation of the compressors. The liquid backflow phenomenon causes frequent starting-operation/stop-operation of the compressors, resulting in compressor wear and degrading of the reliability of the compressors.

SUMMARY OF THE INVENTION

Therefore, the present invention has been made in view of the above problems, and it is an object of the present invention to provide an apparatus for controlling the capacity of an air conditioner having a pair of first and second compressors, in which a 3-way or 4-way direction-switching member and a low-pressure equalizing solenoid valve are provided at a refrigerant path of the air conditioner so that the compression capacity of the air conditioner is adjusted into three stages of 100%, 60%, and 40% using the first and second compressors to enable easy variable-capacity operation, thereby considerably reduced energy consumption and preventing wear of the first and second compressors via a rapid compensation of a pressure imbalance between both the compressors, and a control method using the same.

In accordance with a first aspect of the present invention, the above and other objects can be accomplished by the provision of an apparatus for controlling the capacity of an air conditioner of a continuous variable-capacity type, the air conditioner having a pair of first and second compressors and at least one indoor unit, the apparatus comprising: first and second suction pipes used to diverge a refrigerant that is delivered from the indoor unit via a delivery pipe in order to introduce a refrigerant into the first and second compressors, respectively; first and second discharge pipes used to supply the refrigerant, compressed in the first and second compressors, into a condenser; and a bypass circuit used to connect both the first and second discharge pipes to the delivery pipe in order to equalize a high-pressure that is applied to exit ends of the first and second compressors to a low-pressure that is applied to entrance ends of the compressors.

Preferably, the apparatus may further comprise a check valve to prevent backflow of the refrigerant from the second discharge pipe into the first discharge pipe.

Preferably, the bypass circuit may include: a low-pressure connection pipe used to connect the first discharge pipe to the delivery pipe to equalize the high-pressure of the exit end of the first compressor to the low-pressure; a solenoid valve provided at the low-pressure connection pipe to control the delivery of the refrigerant; a branch pipe used to connect the second discharge pipe to the low-pressure connection pipe; and a direction-switching member mounted over both the second discharge pipe and the branch pipe and adapted to be opened and closed to selectively allow the passage of the refrigerant, in order to equalize the high-pressure of the exit end of the second compressor to the low-pressure.

Preferably, the apparatus may further comprise: a control unit provided to individually control the first and second compressors, the direction-switching member, the solenoid valve, and a stabilizer; and a signal input unit used to input control signals into the control unit.

Preferably, the direction-switching member may take the form of a 3-way control valve or 4-way control valve to individually open and close both the second discharge pipe and the branch pipe.

Preferably, the bypass circuit may include: a low-pressure pipe used to connect the first and second discharge pipes to the delivery pipe to selectively equalize the pressure of the refrigerant passing through the first and second discharge pipes; a solenoid valve provided at the low-pressure pipe to control the delivery of the refrigerant, in order to equalize the pressure of the refrigerant passing through the first discharge pipe to the pressure of the refrigerant passing through the delivery pipe; and a direction-switching member mounted over both the second discharge pipe and the low-pressure pipe and adapted to be opened and closed to selectively connect the first and second discharge pipes to the low-pressure pipe in order to equalize the pressure of the first discharge pipe or the second discharge pipe, or to selectively connect the first and second discharge pipes to a condenser introduction pipe for a selective refrigerant supply.

Preferably, the apparatus may further comprise: a control unit provided to individually control the first and second compressors, the direction-switching member, the solenoid valve, and a stabilizer; and a signal input unit used to input control signals into the control unit.

Preferably, the direction-switching member may take the form of a 4-way control valve to individually open and close both the second discharge pipe and the low-pressure pipe.

Preferably, when the first and second compressors are simultaneously operated, the direction-switching member may be closed to connect the second discharge pipe to the condenser introduction pipe, and the solenoid valve may be closed to connect the first discharge pipe to the condenser introduction pipe via a check valve.

Preferably, when the first compressor is operated and the second compressor is stopped, the direction-switching member may be opened to connect the second discharge pipe to the low-pressure pipe in order to achieve an equalized pressure at the entrance and exit ends of the second compressor, and the solenoid valve may be opened so that a part of the refrigerant passing through the first discharge pipe is delivered into the second discharge pipe via the solenoid valve and the direction-switching member prior to being supplied into the condenser introduction pipe, thereby enabling dispersion in the flow of the refrigerant discharged from the first compressor and achieving a reduction in frictional resistance.

Preferably, when the first compressor is stopped and the second compressor is operated, the direction-switching member may be closed to connect the second discharge pipe to the condenser introduction pipe, and the solenoid valve may be opened to connect the first discharge pipe to the low-pressure pipe to achieve an equalized pressure at the entrance and exit ends of the first compressor.

In accordance with a second aspect of the present invention, the above and other objects can be accomplished by the provision of a method for controlling an air conditioner of a continuous variable-capacity type, the air conditioner having a pair of first and second compressors and at least one indoor unit, the method comprising: inputting desired operational information into a signal input unit to allow a control unit to select a desired operation mode; selectively starting operation of the first and second compressors to perform one of a highest compression capacity operation, a middle compression capacity operation, and a lowest compression capacity operation; determining whether a stabilizer is operated or not by use of the control unit to detect the presence of abnormal operations, and entering a stop-operation mode if the abnormal operation is detected, or ending the starting-operation and entering a normal operation mode if no abnormal operation is detected; determining a required compression load of the first and second compressors based on the load capacity of the indoor unit by use of the control unit, and subsequently, selecting any one normal operation mode from among a load-increase operation, a load-decrease operation, a load-maintaining operation, and a stop-operation; determining whether the stabilizer is operated or not to detect the presence of abnormal operation, and entering the stop-operation mode if the abnormal operation is detected, or continuously performing the normal operation mode if no abnormal operation is detected; and stopping the first and second compressors if an operation stop signal is inputted from the signal input unit into the control unit or if the stop-operation mode is selected as a result of detecting the abnormal operation.

Preferably, the starting of operation of both the first and second compressors to perform the highest compression capacity operation of 100% may comprise: opening a solenoid valve to connect a first discharge pipe to a low-pressure connection pipe to achieve an equalized low pressure, and opening a direction-switching member to connect a second discharge pipe to a branch pipe to achieve an equalized low pressure; operating the first compressor; closing the solenoid valve; operating the second compressor and closing the direction-switching member.

Preferably, in the starting of operation of both the first and second compressors to perform the highest compression capacity operation of 100%, a first indoor unit of a room air conditioner (RAC) type and a second indoor unit of a package air conditioner (PAC) type may be employed so that they are simultaneously operated.

Preferably, the starting of operation of only the first compressor to perform the lowest compression capacity operation of 40% may comprise: opening a solenoid valve to connect a first discharge pipe to a low-pressure connection pipe to achieve an equalized low-pressure, and opening a direction-switching member to connect a second discharge pipe to a branch pipe to achieve an equalized low-pressure; operating the first compressor; and closing the solenoid vale.

Preferably, in the starting of operation of only the first compressor to perform the lowest compression capacity operation of 40%, a first indoor unit of a room air conditioner (RAC) type and a second indoor unit of a package air conditioner (PAC) type may be employed so that only the first indoor unit, having a capacity lower than that of the second indoor unit, is operated.

Preferably, the starting of operation of only the second compressor to perform a middle compression capacity operation of 60% may comprise: opening a direction-switching member to connect a second discharge pipe to a branch pipe to achieve an equalized low-pressure; closing the direction-switching member to connect the second discharge pipe to a condenser; and operating only the second compressor.

Preferably, in the starting of operation of only the second compressor to perform the middle compression capacity operation of 60%, a first indoor unit of a room air conditioner (RAC) type and a second indoor unit of a package air conditioner (PAC) type may be employed so that only the second indoor unit, having a capacity higher than that of the first indoor unit, is operated.

Preferably, the selection of the normal operation mode for increasing the lowest load compression capacity of 40% to the middle load compression capacity of 60% may comprise: operating the second compressor in a state wherein the first compressor is operating; closing the direction-switching member to connect a second discharge pipe to a condenser; stopping the first compressor; and opening a solenoid valve to connect a first discharge pipe to a low-pressure connection pipe to equalize the pressure of the first discharge pipe to a low-pressure, and after the lapse of a predetermined time, closing the solenoid valve.

Preferably, the selection of the normal operation mode for increasing the middle load compression capacity of 60% to the highest load compression capacity of 100% may comprise: opening the solenoid valve during operation of the second compressor to connect a first discharge pipe to a low-pressure connection pipe to achieve an equalized low-pressure; operating the first compressor; and closing the solenoid valve.

Preferably, the selection of the normal operation mode for increasing the lowest load compression capacity of 40% to the highest load compression capacity of 100% may comprise: operating the second compressor in a state wherein the first compressor is operating; and closing a direction-switching member to connect a second discharge pipe to a condenser.

Preferably, the selection of the normal operation mode for decreasing the highest load compression capacity of 100% to the middle load compression capacity of 60% may comprise:

stopping the first compressor in a state wherein the second compressor is still operating; opening a solenoid valve to connect a first discharge pipe to a low-pressure connection pipe to achieve an equalized low-pressure; and closing the solenoid valve.

Preferably, the selection of the normal operation mode for decreasing the middle load compression capacity of 60% to the lowest load compression capacity of 40% may comprise: opening a solenoid valve during operation of the second compressor to connect a first discharge pipe to a low-pressure connection pipe to achieve an equalized low-pressure; operating the first compressor; closing the solenoid valve; and opening a direction-switching member to connect a second discharge pipe to a branch pipe to achieve an equalized low-pressure, and subsequently, stopping the second compressor.

Preferably, the selection of the normal operation mode for decreasing the highest load compression capacity of 100% to the lowest load compression capacity of 40% may comprise: opening a direction-switching member during operation of the first and second compressors to connect a second discharge pipe to a branch pipe to achieve an equalized low-pressure; and stopping the second compressor.

Preferably, the selection of the normal operation mode for selectively stopping the first and second compressors to stop the lowest load compression capacity operation of 40% may comprise: closing a discharge-switching member to connect a second discharge pipe to a condenser; and stopping the first compressor.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be explained with reference to the accompanying drawings.

The embodiments of the present invention are not intended to limit the scope of the present invention, but are provided for the sake of exemplification.

Figure 1:
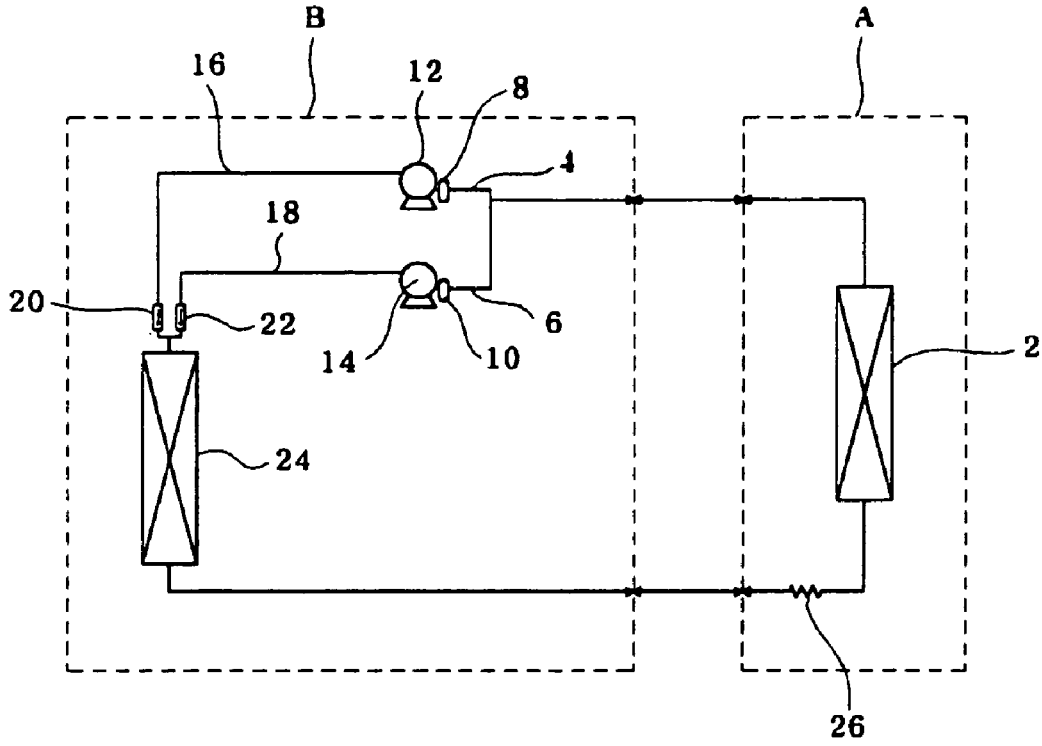
Prior Art FIG. 1
FIG. 1 is a configuration diagram illustrating a conventional air conditioner having first and second compressors.
Figure 2:
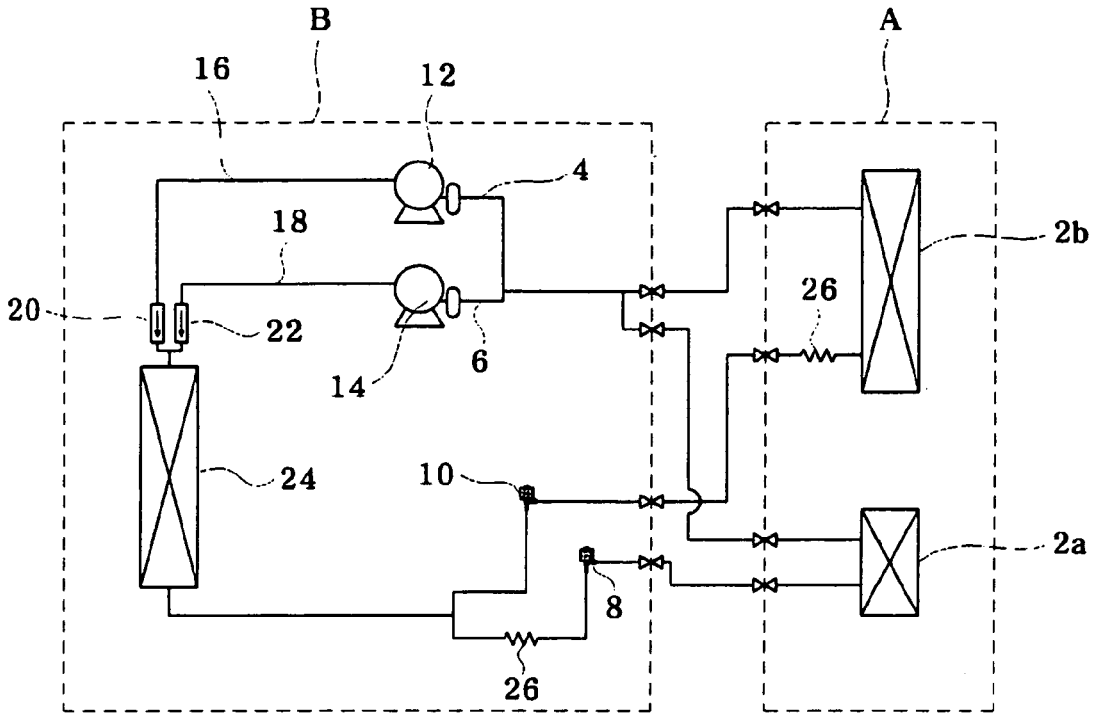
Prior Art FIG. 2
FIG. 2 is a configuration diagram illustrating another conventional air conditioner having first and second compressors and first and second indoor units.
Figure 3:
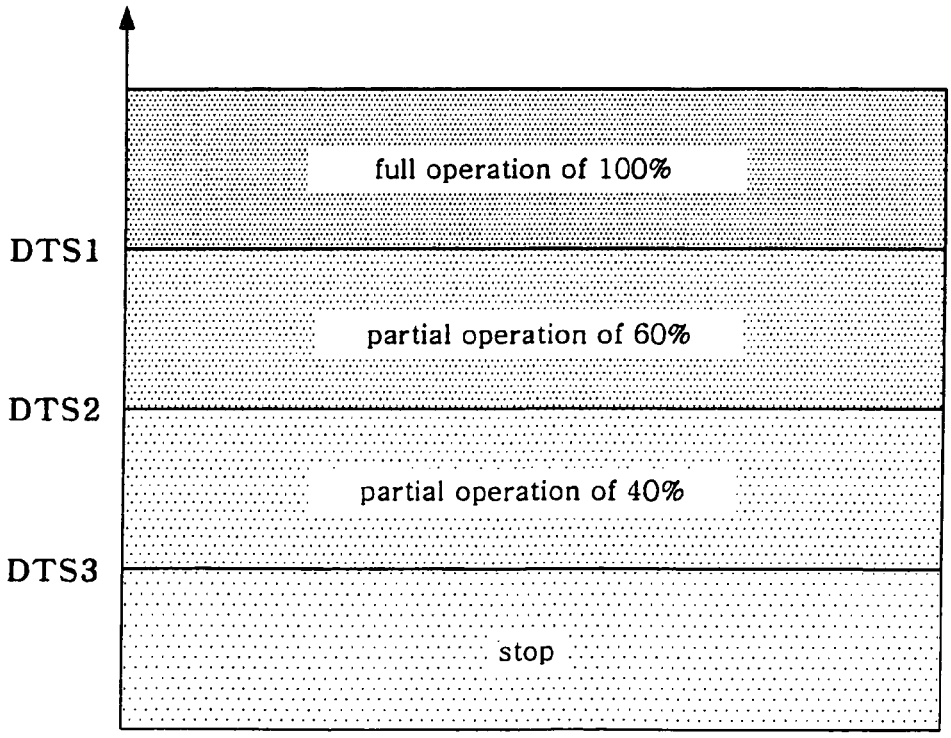
FIG. 3 is a diagram illustrating a conventional capacity control method using the first and second compressors.
Figure 4:
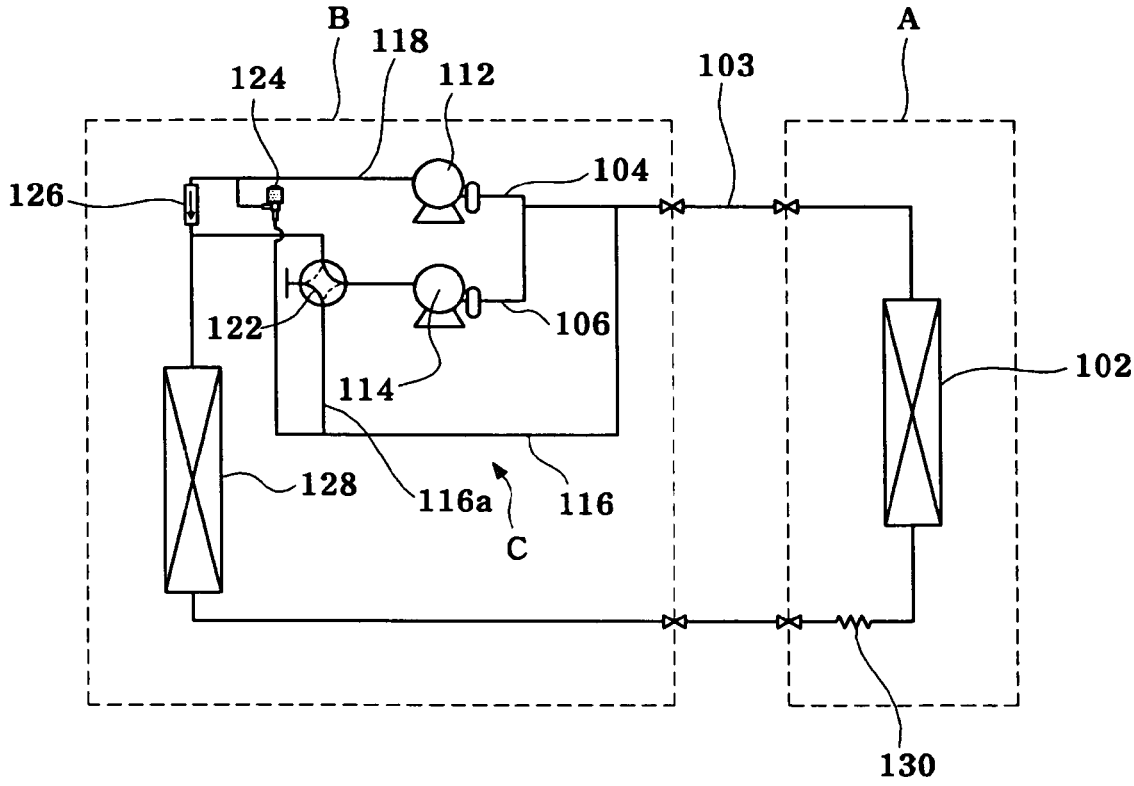
FIG. 4 is a configuration diagram illustrating an air conditioner having first and second compressors in accordance with a first embodiment of the present invention.
Figure 5:
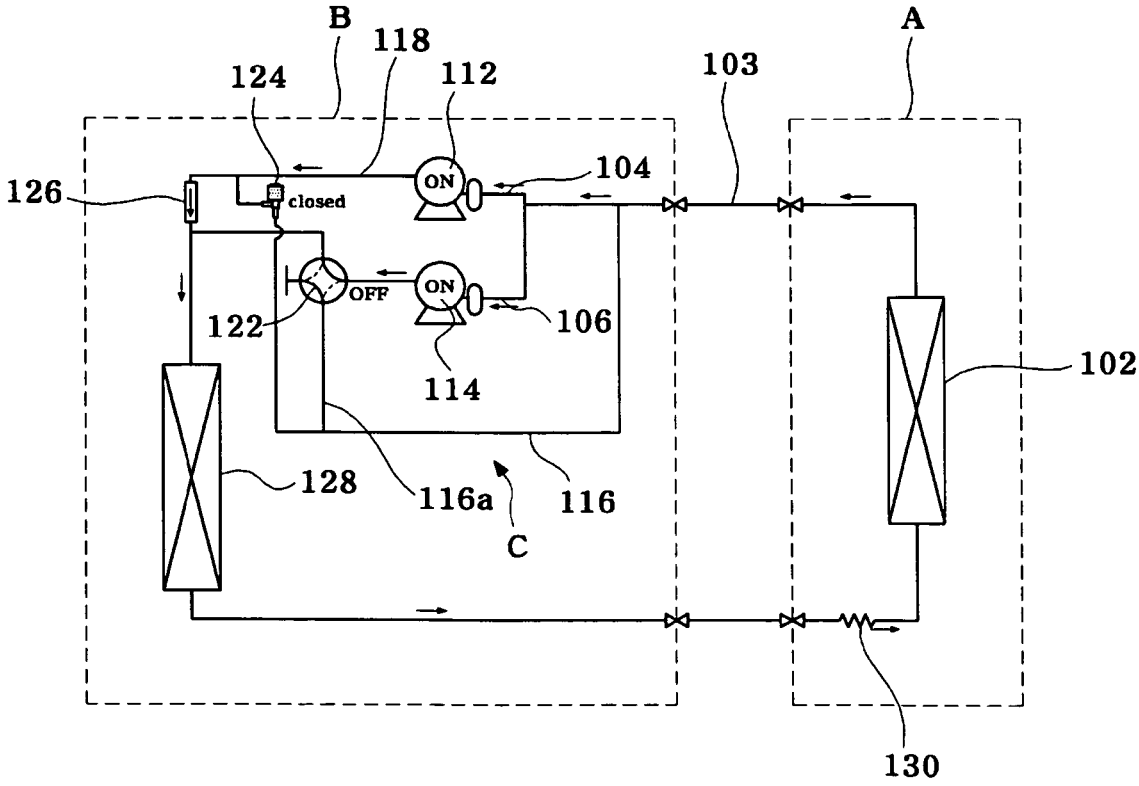
FIG. 5 is a diagram illustrating the flow of a refrigerant upon a full-load compression operation using the first and second compressors in accordance with the first embodiment of the present invention.
Figure 6:
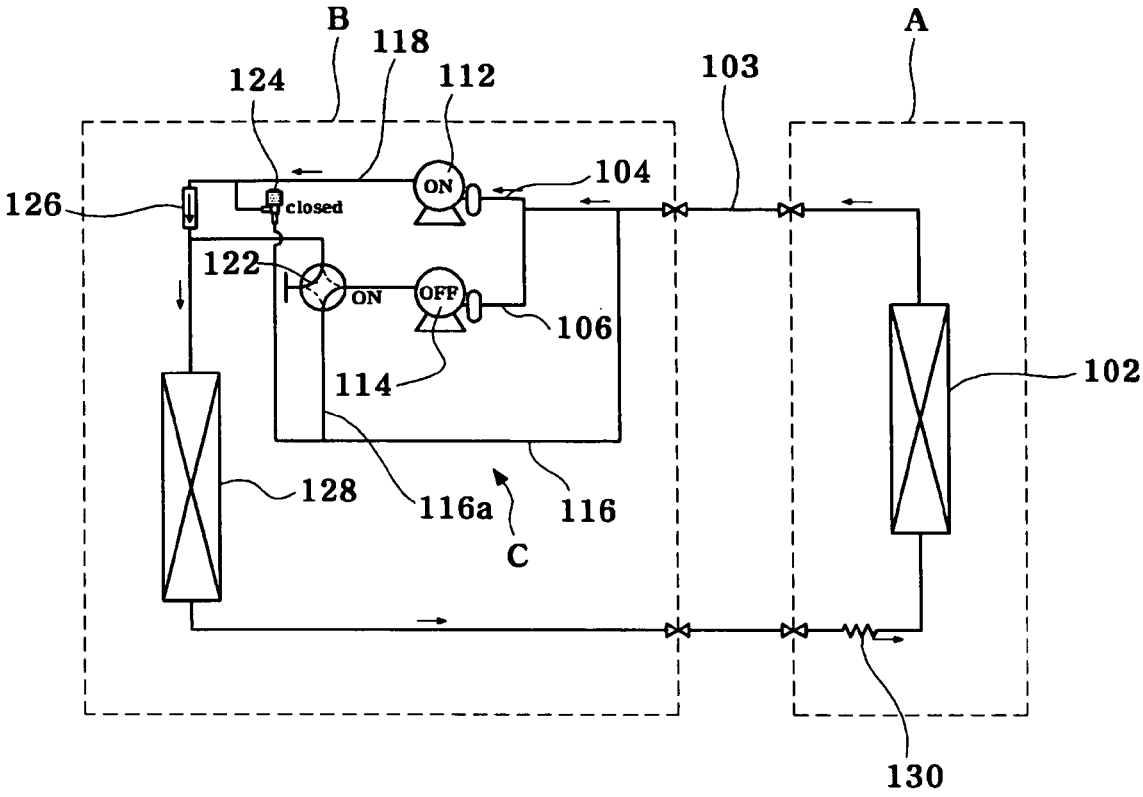
FIG. 6 is a diagram illustrating the flow of a refrigerant upon a partial-load compression operation using only the first compressor in accordance with the first embodiment of the present invention.
Figure 7:
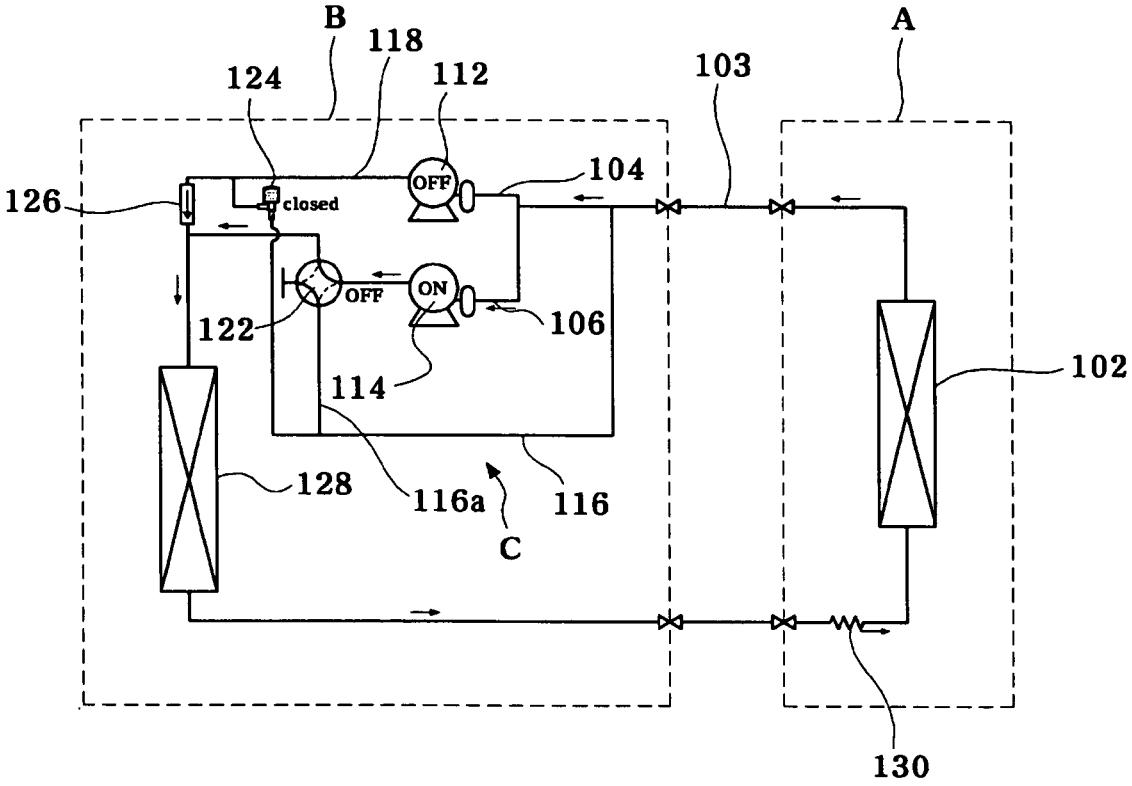
FIG. 7 is a diagram illustrating the flow of a refrigerant upon a partial-load compression operation using only the second compressor in accordance with the first embodiment of the present invention.
Figure 8:
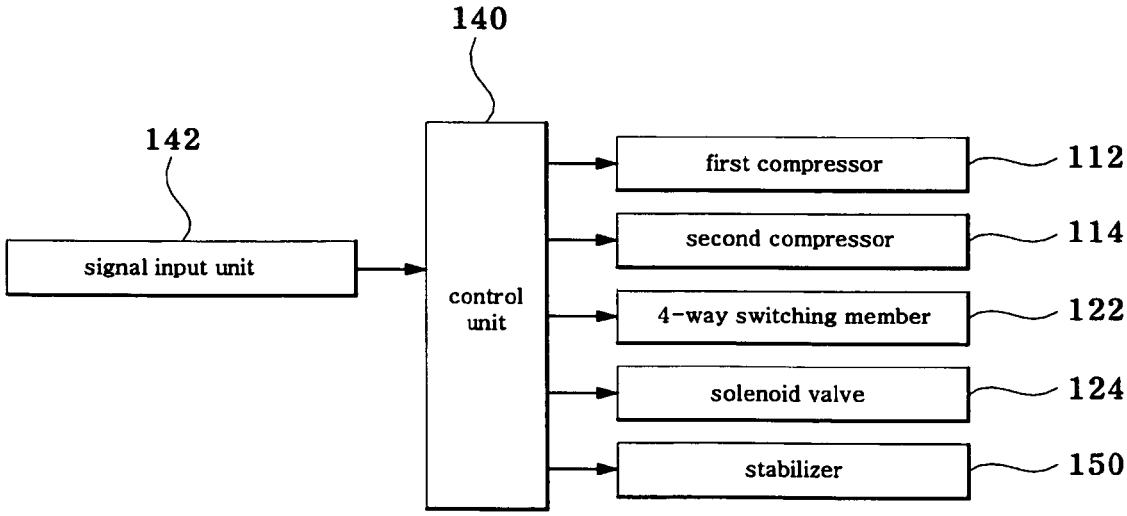
FIG. 8 is a configuration diagram illustrating a capacity control apparatus of the air conditioner in accordance with the first embodiment of the present invention.

FIG. 4 is a configuration diagram illustrating an air conditioner having first and second compressors in accordance with a first embodiment of the present invention. FIG. 5 is a diagram illustrating the flow of a refrigerant upon a full-load compression operation using the first and second compressors in accordance with the first embodiment of the present invention. FIG. 6 is a diagram illustrating the flow of a refrigerant upon a partial-load compression operation using only the first compressor in accordance with the first embodiment of the present invention. FIG. 7 is a diagram illustrating the flow of a refrigerant upon a partial-load compression operation using only the second compressor in accordance with the first embodiment of the present invention. FIG. 8 is a configuration diagram illustrating a capacity control apparatus of the air conditioner in accordance with the first embodiment of the present invention.

The air conditioner in accordance with the first embodiment of the present invention is a variable-capacity compressor comprising a pair of first and second compressors 112 and 114 and a single indoor unit 102. The capacity control apparatus provided in the air conditioner comprises: first and second suction pipes 104 and 106 used to diverge a refrigerant that is delivered from the indoor unit 102 via a delivery pipe 103 in order to introduce the refrigerant into the first and second compressors 112 and 114, respectively; first and second discharge pipes 118 and 120 used to supply the refrigerant, compressed in the first and second compressors 112 and 114, into a condenser 128; and a bypass circuit C used to connect both the first and second discharge pipes 118 and 120 to the delivery pipe 103 in order to equalize a high-pressure that is applied to the exit ends of the first and second compressors 112 and 114 to a low-pressure that is applied to entrance ends of the compressors 112 and 114.

The capacity control apparatus further comprises a check valve 126 to prevent backflow of the refrigerant from the second discharge pipe 120 into the first discharge pipe 118.

The bypass circuit C includes: a low-pressure connection pipe 116 used to connect the first discharge pipe 118 to the delivery pipe 103 to equalize the high-pressure of the exit end of the first compressor 112 to the low-pressure of the delivery pipe 103; a solenoid valve 124 provided at the low-pressure connection pipe 116 to control the delivery of the refrigerant; a branch pipe 116*a* used to connect the second discharge pipe 120 to the low-pressure connection pipe 116; and a direction-switching member 122 mounted over both the second discharge pipe 120 and the branch pipe 116*a* and adapted to be opened and closed to selectively allow the passage of the refrigerant, in order to equalize the high-pressure of the exit end of the second compressor 114 to the low-pressure of the delivery pipe 103.

The capacity control apparatus further comprises: a control unit 140 provided to individually control the first and second compressors 112 and 114, the direction-switching member 122, the solenoid valve 124, and a stabilizer 150; and a signal input unit 142 used to input control signals into the control unit 140.

The direction-switching member 122 takes the form of a 3-way control valve or 4-way control valve to individually open and close both the second discharge pipe 120 and the branch pipe 116*a*.

In the first embodiment using the pair of first and second compressors 112 and 114 and the single indoor unit 102, the control unit 140 carries out a control operation in such a fashion that only the first compressor 112 is operated if the load capacity of the indoor unit 102 is less than 40%, only the second compressor 114 is operated if the load capacity of the indoor unit 102 is less than 60%, and both the first and second compressors 112 and 114 are operated if the load capacity is 100%.

Figure 9:
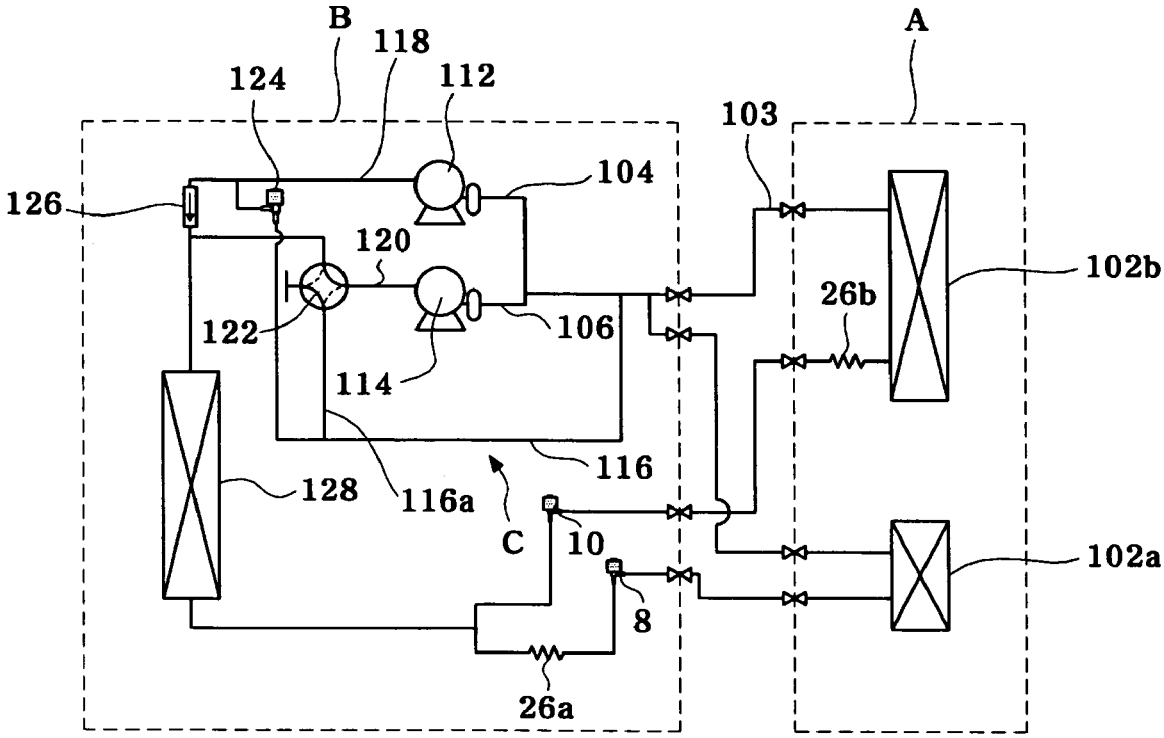
FIG. 9 is a configuration diagram illustrating an air conditioner having first and second compressors and first and second indoor units in accordance with a second embodiment of the present invention.
Figure 10:
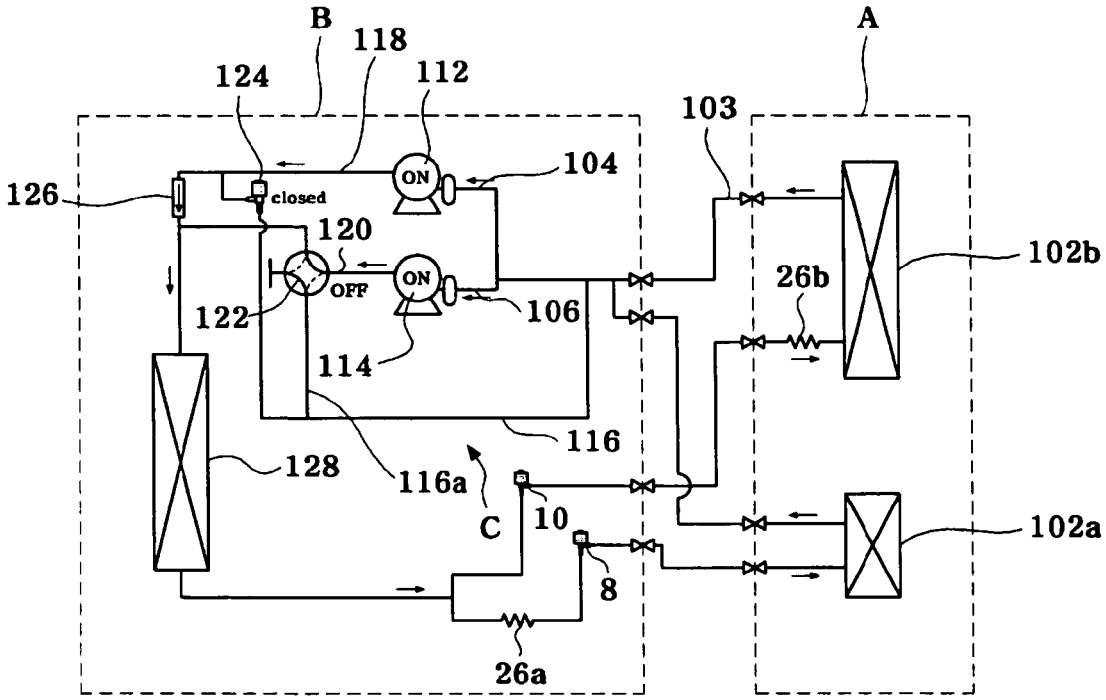
FIG. 10 is a diagram illustrating the flow of a refrigerant upon a full-load compression operation using the first and second compressors and the first and second indoor units in accordance with the second embodiment of the present invention.
Figure 11:
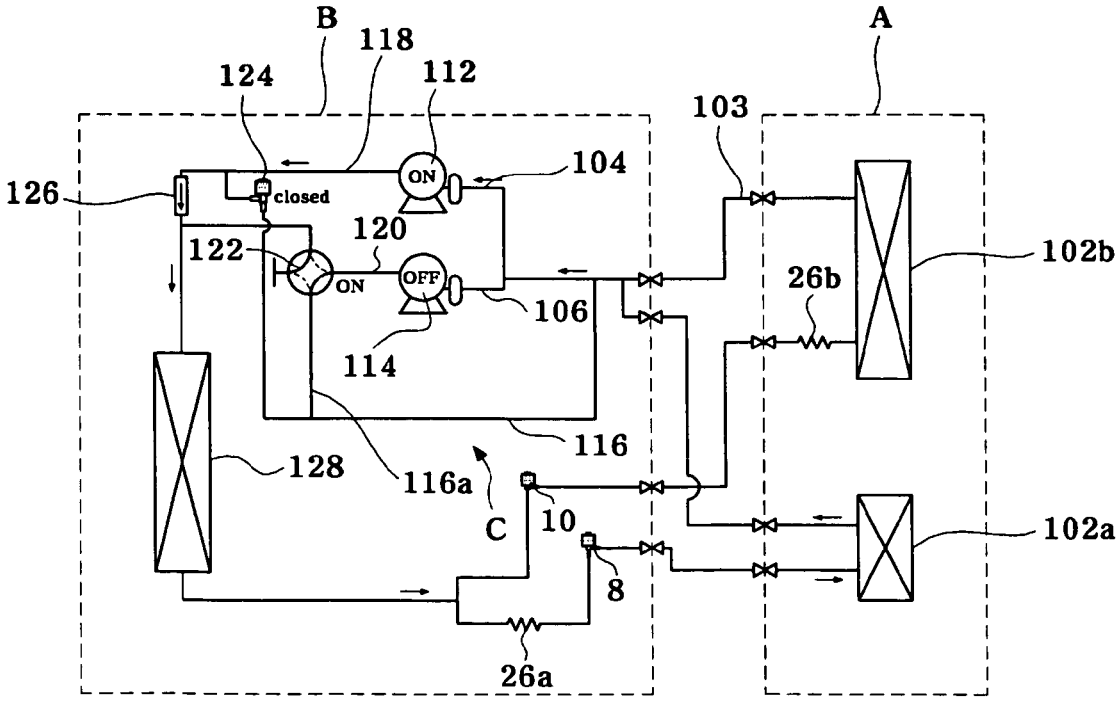
FIG. 11 is a diagram illustrating the flow of a refrigerant upon a partial-load compression operation using only the first compressor and the first indoor unit in accordance with the second embodiment of the present invention.
Figure 12:
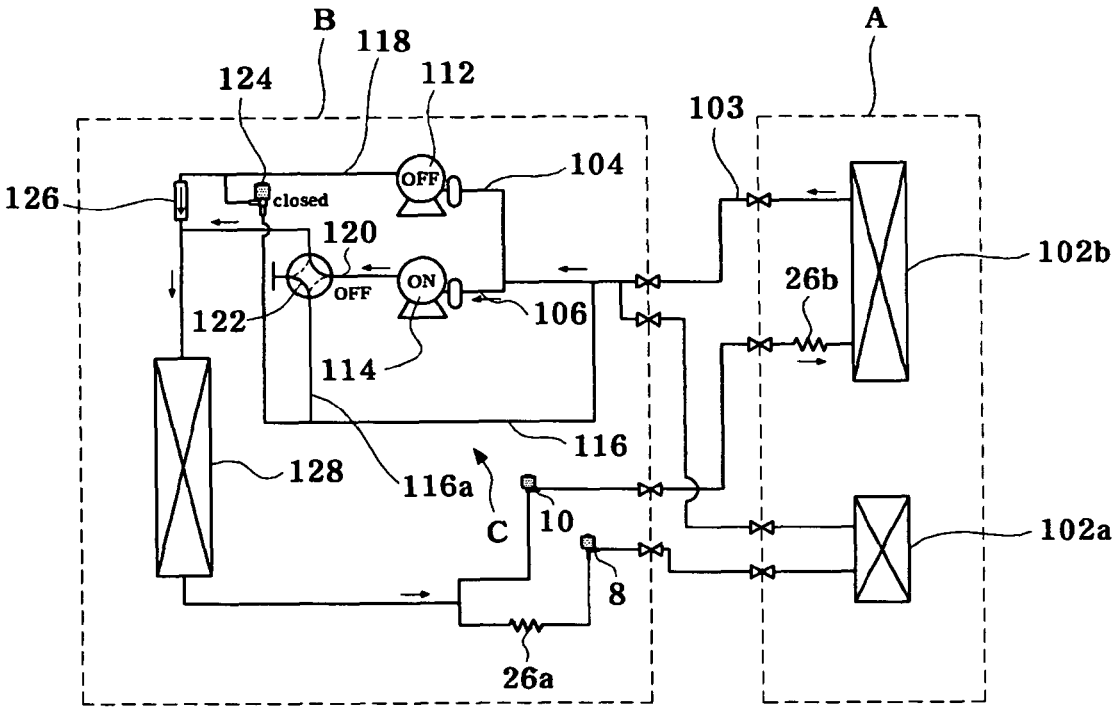
FIG. 12 is a diagram illustrating the flow of a refrigerant upon a partial-load compression operation using only the second compressor and the second indoor unit in accordance with the second embodiment of the present invention.
Figure 13:
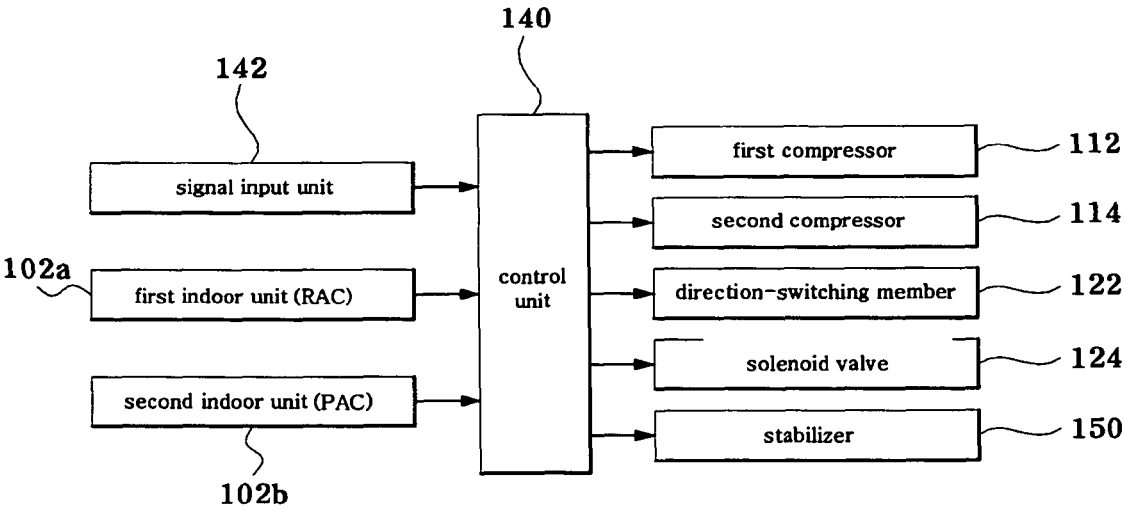
FIG. 13 is a configuration diagram illustrating a capacity control apparatus of the air conditioner in accordance with the second embodiment of the present invention.

FIG. 9 is a configuration diagram illustrating an air conditioner having first and second compressors and first and second indoor units in accordance with a second embodiment of the present invention. FIG. 10 is a diagram illustrating the flow of a refrigerant upon a full-load compression operation using the first and second compressors and the first and second indoor units in accordance with the second embodiment of the present invention. FIG. 11 is a diagram illustrating the flow of a refrigerant upon a partial-load compression operation using only the first compressor and the first indoor unit in accordance with the second embodiment of the present invention. FIG. 12 is a diagram illustrating the flow of a refrigerant upon a partial-load compression operation using only the second compressor and the second indoor unit in accordance with the second embodiment of the present invention. FIG. 13 is a configuration diagram illustrating a capacity control apparatus of the air conditioner in accordance with the second embodiment of the present invention.

The air conditioner in accordance with the second embodiment of the present invention is a variable-capacity compressor comprising the pair of first and second compressors 112 and 114 for use in the compression of a refrigerant and a pair of first and second indoor units 102*a* and 102*b* designed to be selectively operated in accordance with operation of the first and second compressors 112 and 144 for the air conditioning of a room. The capacity control apparatus of the air conditioner according to the second embodiment comprises: the pair of first and second suction pipes 104 and 106 used to diverge a refrigerant that is delivered from the first and second indoor units 102*a* and 102*b* via the delivery pipe 103 in order to introduce the refrigerant into the first and second compressors 112 and 114, respectively; first and second discharge pipes 118 and 120 used to supply the refrigerant, compressed in the first and second compressors 112 and 114, into the condenser 128; and the bypass circuit C used to connect the delivery pipe 103 to both the first and second discharge pipes 118 and 120 in order to equalize the high-pressure that is applied to exit ends of the first and second compressors 112 and 114 to a low-pressure that is applied to entrance ends of the compressors 112 and 114.

The capacity control apparatus of the second embodiment further comprises the check valve 126 to prevent the backflow of the refrigerant from the second discharge pipe 120 into the first discharge pipe 118.

The bypass circuit C includes: the low-pressure connection pipe 116 used to connect the first discharge pipe 118 to the delivery pipe 103 to equalize the high-pressure of the exit end of the first compressor 112 to the low-pressure of the delivery pipe 103; the solenoid valve 124 provided at the low-pressure connection pipe 116 to control the delivery of the refrigerant; the branch pipe 116*a* used to connect the second discharge pipe 120 to the low-pressure connection pipe 116; and a direction-switching member 122 mounted over both the second discharge pipe 120 and the branch pipe 116*a* and adapted to be opened and closed to selectively allow the passage of the refrigerant, in order to equalize the high-pressure of the exit end of the second compressor 114 to the low-pressure.

The capacity control apparatus further comprises: a first selector valve 8 used to selectively deliver the refrigerant condensed in the condenser 128 to the first indoor unit 102*a*; and a second selector valve 10 used to selectively deliver the refrigerant condensed in the condenser 128 to the second indoor unit 102*b*. Here, the first indoor unit 102*a* is of a room air conditioner (RAC) type, and the second indoor unit 102*b* is of a package air conditioner (PAC) type.

A pair of refrigerant expansion valves 26*b* and 26*a* is provided upstream and downstream of the first and second selector valves 8 and 10, respectively.

The control unit 140 is provided to individually control the first and second compressors 112 and 114, the direction-switching member 122, the solenoid valve 124, the first and second indoor units 102*a* and 102*b*, and the stabilizer 150. The control unit 140 is adapted to receive control signals from the signal input unit 142.

The direction-switching member 122 takes the form of a 3-way control valve or 4-way control valve to individually open and close both the second discharge pipe 120 and the branch pipe 116*a*.

In the second embodiment using the pair of first and second compressors 112 and 114 and a pair of indoor units 102*a* and 102*b*, the control unit 140 carries out a control operation in such a fashion that only the first compressor 112 is operated if the total load capacity of the indoor units 102*a* and 102*b* is less than 40%, only the second compressor 114 is operated if the total load capacity of the indoor units 102 and 102*b* is less than 60%, and both the first and second compressors 112 and 114 are operated if the total load capacity is 100%.

Figure 14:
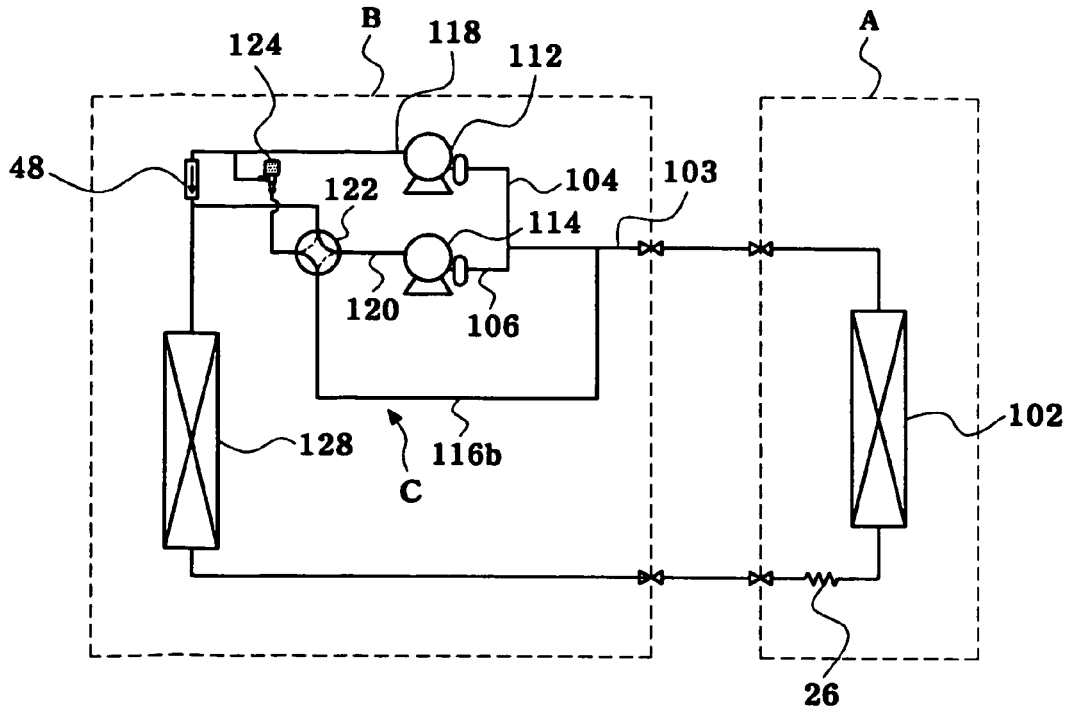
FIG. 14 is a configuration diagram illustrating an air conditioner having first and second compressors in accordance with a third embodiment of the present invention.
Figure 15:
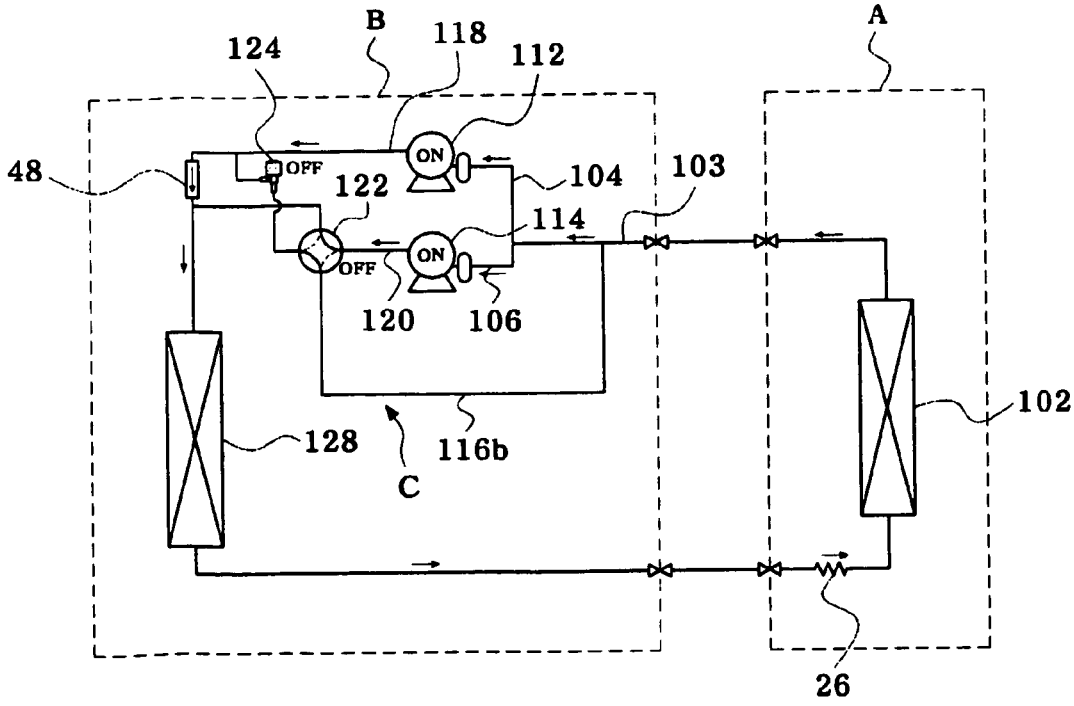
FIG. 15 is a diagram illustrating the flow of a refrigerant upon a full-load compression operation using the first and second compressors in accordance with the third embodiment of the present invention.
Figure 16:
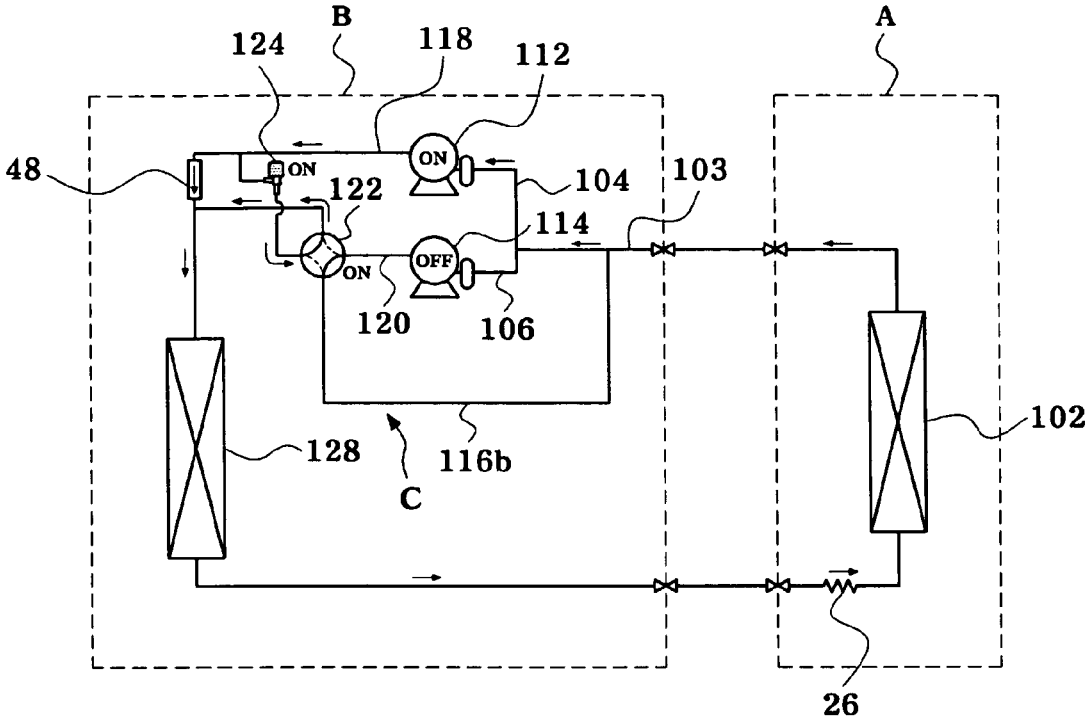
FIG. 16 is a diagram illustrating the flow of a refrigerant upon a partial-load compression operation using only the first compressor in accordance with the third embodiment of the present invention, in a state wherein a solenoid valve is opened.
Figure 17:
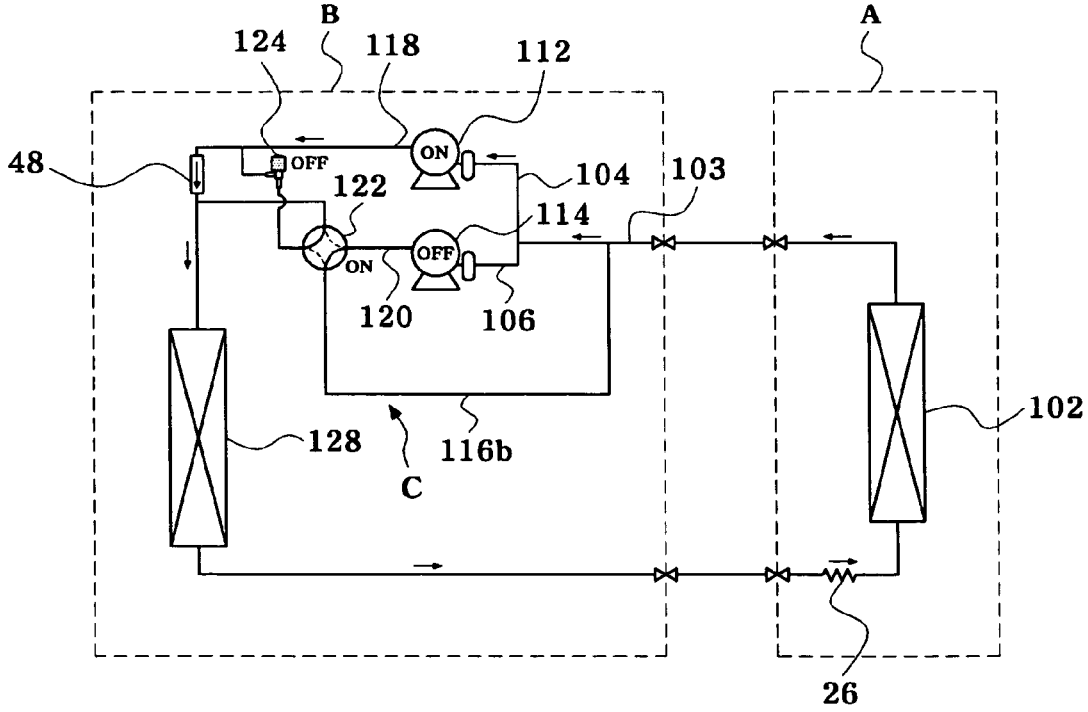
FIG. 17 is a diagram similar to FIG. 16, in a state wherein a solenoid valve is closed.
Figure 18:
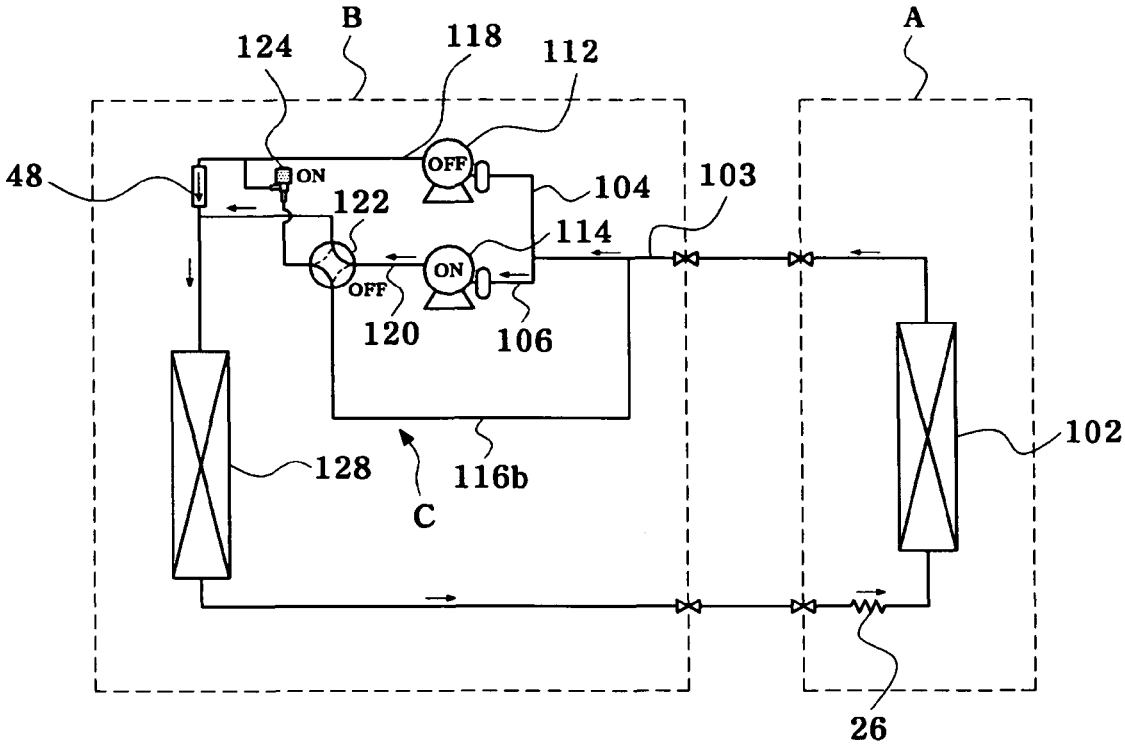
FIG. 18 is a diagram illustrating the flow of a refrigerant upon a partial-load compression operation using only the second compressor in accordance with the third embodiment of the present invention.
Figure 19:
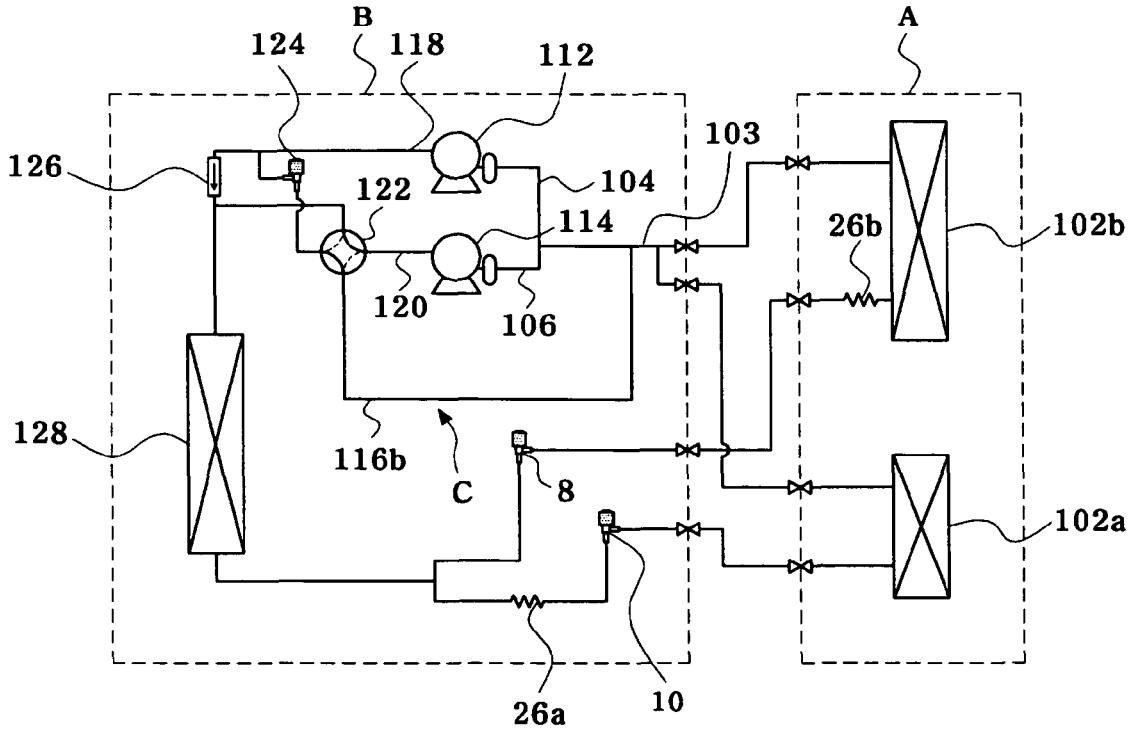
FIG. 19 is a configuration diagram illustrating an air conditioner having first and second compressors and first and second indoor units in accordance with an alternative example of the third embodiment of the present invention.

FIG. 14 is a configuration diagram illustrating an air conditioner having first and second compressors in accordance with a third embodiment of the present invention. FIG. 15 is a diagram illustrating the flow of a refrigerant upon a full-load compression operation using the first and second compressors in accordance with the third embodiment of the present invention. FIG. 16 is a diagram illustrating the flow of a refrigerant upon a partial-load compression operation using only the first compressor in accordance with the third embodiment of the present invention, in a state wherein a solenoid valve is opened. FIG. 17 is a diagram similar to FIG. 16, in a state wherein a solenoid valve is closed. FIG. 18 is a diagram illustrating the flow of a refrigerant upon a partial-load compression operation using only the second compressor in accordance with the third embodiment of the present invention. FIG. 19 is a configuration diagram illustrating an air conditioner having first and second compressors and first and second indoor units in accordance with an alternative example of the third embodiment of the present invention.

The air conditioner in accordance with the third embodiment of the present invention is a variable-capacity compressor comprising the first and second compressors 112 and 114 and the single indoor unit 102. The capacity control apparatus of the air conditioner comprises: first and second suction pipes 104 and 106 used to diverge a refrigerant that is delivered from the indoor unit 102 via the delivery pipe 103 in order to introduce the refrigerant into the first and second compressors 112 and 114, respectively; first and second discharge pipes 118 and 120 used to discharge the compressed refrigerant from the first and second compressors 112 and 114; and a bypass circuit C used to connect the delivery pipe 103 to both the first and second discharge pipes 118 and 120 in order to equalize a high-pressure that is applied to exit ends of the first and second compressors 112 and 114 to a low-pressure that is applied to the entrance ends of the compressors 112 and 114.

The capacity control apparatus of the third embodiment further comprises a check valve 48 to prevent the backflow of the refrigerant from the second discharge pipe 120 into the first discharge pipe 118.

The bypass circuit C includes: a low-pressure connection pipe 116*b* used to connect the first and second discharge pipes 118 and 120 to the delivery pipe 103 to equalize the pressure of the refrigerant passing through the first and second discharge pipes 118 and 120 to the low-pressure of the delivery pipe 103; the solenoid valve 124 provided at the low-pressure connection pipe 116*b* to control the delivery of a refrigerant, so that the refrigerant of the first discharge pipe 118 has the same pressure as that of the delivery pipe 103; and the direction-switching member 122 mounted over both the second discharge pipe 120 and the low-pressure connection pipe 116*b* and adapted to selectively interconnect the first and second discharge pipes 118 and 120 with the low-pressure connection pipe 116*b* to selectively equalize the pressure of the refrigerant passing through the discharge pipes 118 and 120 to the low-pressure of the delivery pipe 103, or adapted to interconnect the first and second discharge pipes 118 and 120 with the condenser 128 to selectively supply the refrigerant into the condenser 128.

The control unit 140 is provided to individually control the first and second compressors 112 and 114, the direction-switching member 122, the solenoid valve 124, and the stabilizer 150. The control unit 140 is adapted to receive control signals from the signal input unit 142.

Preferably, the direction-switching member 122 takes the form of a 4-way control valve.

Assuming that the total compression capacity of the first and second compressors 112 and 114 is 100%, the first compressor 112 is designed to carry out a partial compression capacity of 40%, and the second compressor 114 is designed to carry out a partial compression capacity of 60%. Although the compression capacity ratio of the first and second compressors 112 and 114 is appropriately adjustable in consideration of the load capacity of the indoor unit 102, the above mentioned compression capacity ratio of 4:6 is most preferable.

Referring to FIG. 15, when the first and second compressors 112 and 114 are simultaneously operated (ON), the direction-switching member 122 is closed (OFF) to connect the second discharge pipe 120 to the condenser 128. In this case, the solenoid valve 124 is closed (OFF) to connect the first discharge pipe 118 to the condenser 128 via the check valve 48.

Referring to FIG. 16, when the first compressor 112 is operated (On) and the second compressor 114 is stopped (OFF), the direction-switching member 122 is opened (ON) to connect the second discharge pipe 120 to the low-pressure connection pipe 116*b*, thereby achieving an equalized pressure at the entrance and exit ends of the second compressor 114. In this case, the solenoid valve 124 is opened (ON), so that a part of the refrigerant passing through the first discharge pipe 118 is delivered into the second discharge pipe 120 by passing through the opened solenoid valve 124 and direction-switching member 122 prior to being delivered to the condenser 128. This has the effect of dispersing the flow of refrigerant discharged from the first compressor 112, resulting in a reduction in frictional resistance.

Referring to FIG. 17, when the first compressor 112 is operated (ON) and the second compressor 114 is stopped (OFF), the solenoid valve 124 is closed (OFF) so that the refrigerant compressed in the first compressor 112 is delivered to the condenser 128 by way of the first discharge pipe 118.

Referring to FIG. 18, when the first compressor is stopped (OFF) and the second compressor 114 is operated (ON), the solenoid valve 124 is opened (ON) and the direction-switching member 122 is closed (OFF) so that the second discharge pipe 120 is connected to the condenser 128 and the first discharge pipe 118 is connected to the low-pressure connection pipe 116*b* to achieve an equalized pressure at the entrance and exit ends of the first compressor 112.

In an alternative example of the third embodiment as shown in FIG. 19, the first and second compressors 112 and 114 are designed to cooperate with the first and second indoor units 102*a* and 102*b*, respectively, to enable an adjustment in the total load capacity of the indoor units 102 and 102*b*. Similar to the second embodiment, when using the first and second compressors 112 and 114 and the first and second indoor units 102*a* and 102*b*, the control unit 140 carries out a control operation in such a fashion that only the first compressor 112 and the first indoor unit 102*a* are operated if the total load capacity is less than 40%, only the second compressor 114 and the second indoor unit 102*b* are operated if the total load capacity is less than 60%, and the first and second compressors 112 and 114 and the first and second indoor units 102*a* and 102*b* are operated if the total load capacity is 100%. Remaining configuration of the alternative example is identical to the third embodiment, and thus, no detailed description will be given.

Although the single indoor unit 102 and the pair of first and second indoor units 102*a* and 102*b* have been described heretofore, the number of indoor units can be appropriately increased if necessary.

Now, a method for controlling the capacity of the air conditioner according to the present invention will be explained with reference to the accompanying drawings.

Figure 20:
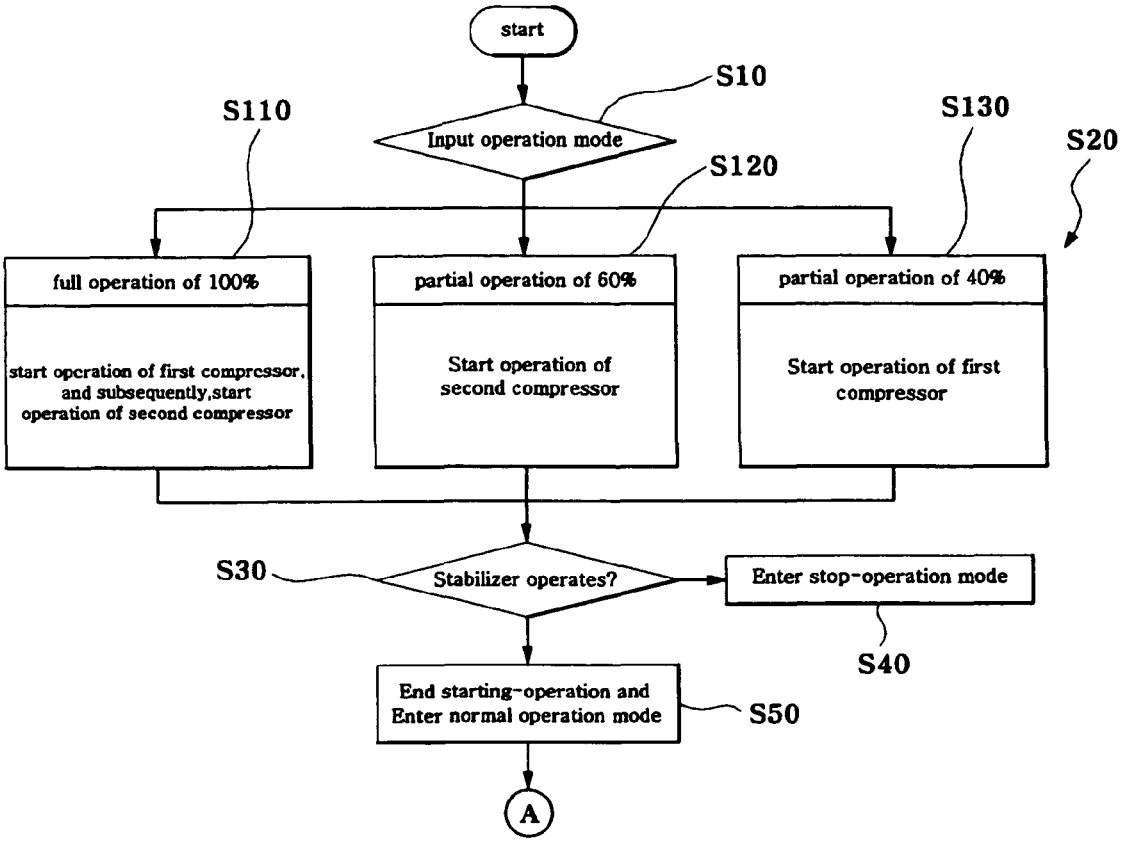
FIG. 20 is a flow chart illustrating a starting-operation control procedure in accordance with the present invention.

When the single indoor unit 102 is employed as shown in FIGS. 7 and 20, desired operational information is input to the signal input unit 142, so that the control unit 140 selects a desired operation mode at step S10.

Also, when the RAC type first indoor unit 102*a* and the PAC type second indoor unit 102*b* are employed as shown in FIG. 12, desired operational information is input to the signal input unit 142, so that the control unit 140 selects a desired load capacity of the first and second indoor units 102*a* and 102*b* in accordance with a corresponding operation mode at step S10.

After the step S10, the first and second compressors 112 and 114 are selectively operated to carry out a desired starting-operation mode suitable for the highest compression capacity, a middle compression capacity, and a lowest compression capacity at step S20.

Figure 21:
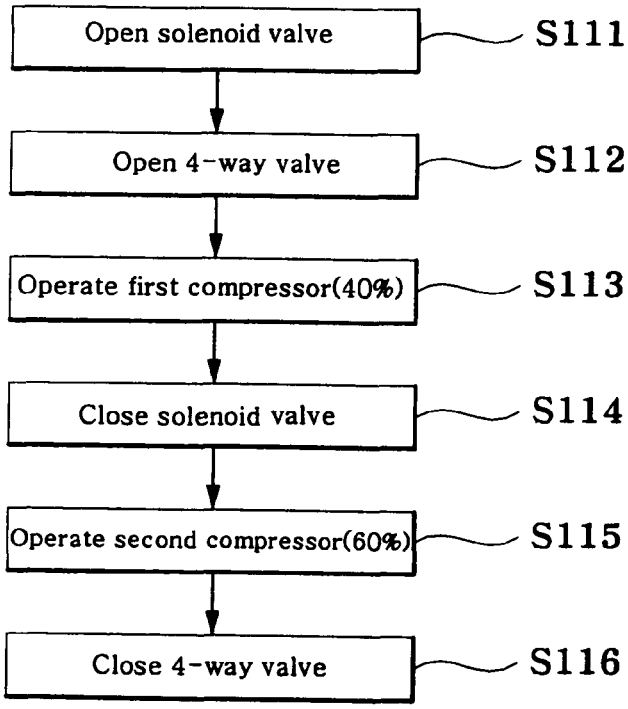
FIG. 21 is a flow chart illustrating a starting-operation control procedure under a full-load compression capacity of 100% in accordance with the present invention.

For example, if the highest compression capacity starting-operation of 100% is selected at the step S20, both the first and second compressors 112 and 114 are operated at step S110 as shown in FIG. 21. In this case, first, the solenoid valve 124 is opened (ON) to connect the first discharge pipe 118 to the low-pressure connection pipe 116, so that the entrance and exit ends of the first compressor 112 are affected by an equalized low-pressure at step S111.

Subsequently, the direction-switching member 122 is opened (ON) to connect the second discharge pipe 120 to the low-pressure connection pipe 116 via the branch pipe 116*a* or to directly connect the second discharge pipe 120 to the low-pressure connection pipe 116*b*, so that the entrance and exit ends of the second compressor 114 are affected by an equalized low-pressure at step S112.

After that, the first compressor 112 is operated at step S113, and the solenoid valve 124 is closed at step S114.

Subsequently, the second compressor 114 is operated at step S115, and the direction-switching member 122 is closed (OFF) at step S116.

In this case, when the single indoor unit 102 is employed as shown in FIG. 5, a refrigerant, having passed through the expansion valve 130, is used to carry out a full-load compression capacity cooling operation of 100% in the indoor unit 102, and then, is returned to the first and second compressors 112 and 114. Also, when the first and second indoor units 102*a* and 102*b* are employed as shown in FIG. 10, the first and second selector valves 8 and 10 are simultaneously opened, so that a refrigerant, having passed through the first and second expansion valve 26*a* and 26*b*, is used to carry out a full-load compression capacity cooling operation of 100% in the indoor units 102*a* and 102*b*, and then, is returned to the first and second compressors 112 and 114.

Figure 22:
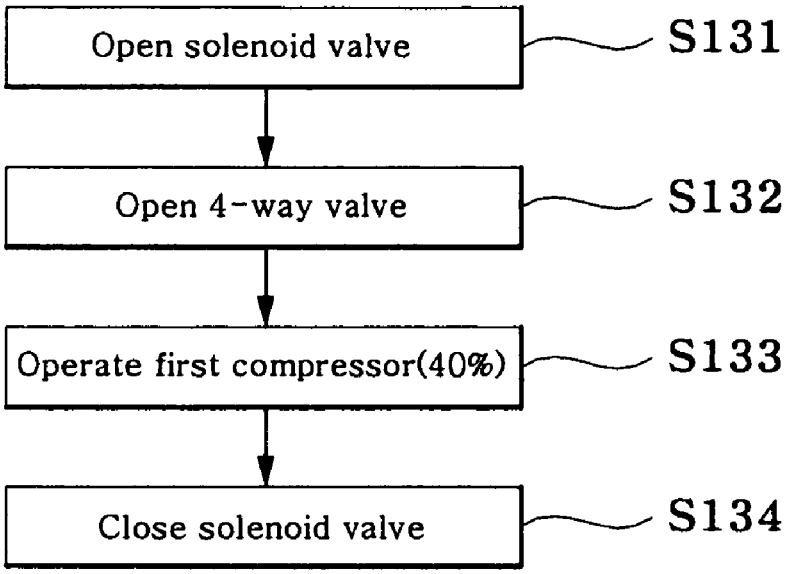
FIG. 22 is a flow chart illustrating a starting-operation control procedure under a partial-load compression capacity of 40% in accordance with the present invention.

Referring to FIG. 22, if the lowest compression capacity starting-operation of 40% is selected at step S20, only the first compressor 112 is operated at step S130. In this case, first, the solenoid valve 124 is opened (ON) to connect the first discharge pipe 118 to the low-pressure connection pipe 116, so that the entrance and exit ends of the first compressor 112 are affected by an equalized low-pressure at step S131. Then, the direction-switching member 122 is opened (ON) to connect the second discharge pipe 120 to the low-pressure connection pipe 116 via the branch pipe 116*a* or to directly connect the second discharge pipe 120 to the low-pressure connection pipe 116*b*, so that the entrance and exit ends of the second compressor 114 are affected by an equalized low-pressure at step S132.

After that, the first compressor 112 is operated at step S133, and then, the solenoid valve 124 is closed (OFF) at step S134.

In this case, when the single indoor unit 102 is employed as shown in FIG. 6, a refrigerant, having passed through the expansion valve 130, is used to carry out a partial-load compression capacity cooling operation of 40% in the indoor unit 102, and then, is returned to the first compressor 112. Also, when the first and second indoor units 102*a* and 102*b* are employed as shown in FIG. 11, the second selector valve 10 is closed and the first selector valve 8 is opened, so that a refrigerant, having passed through the first expansion valve 26*a*, is used to carry out a partial-load compression capacity cooling operation of 40% in the first indoor unit 102*a*, and then, is returned to the first compressor 112.

Figure 23:
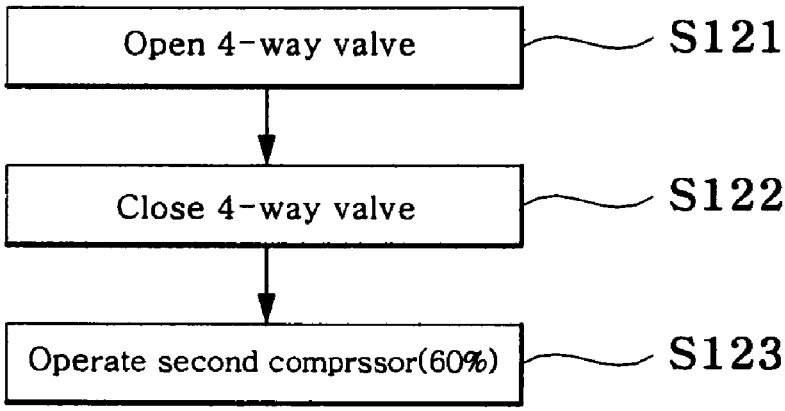
FIG. 23 is a flow chart illustrating a starting-operation control procedure under a partial-load compression capacity of 60% in accordance with the present invention.

Referring to FIG. 23, if the middle compression capacity starting-operation of 60% is selected at the step S20, only the second compressor 114 is operated at step S120. In this case, first, the direction-switching member 122 is opened (ON) to connect the second discharge pipe 120 to the low-pressure connection pipe 116 via the branch pipe 116*a* or to directly connect the second discharge pipe 120 to the low-pressure connection pipe 116*b*, so that the entrance and exit ends of the second compressor 114 are affected by an equalized low-pressure at step S121.

After that, the direction-switching member 122 is closed (OFF) to connect the second discharge pipe 120 to the condenser 128 at step S122, and then, only the second compressor 123 is operated (ON) at step S123.

In this case, when the single indoor unit 102 is employed as shown in FIG. 7, a refrigerant, having passed through the expansion valve 130, is used to carry out a partial-load compression capacity cooling operation of 60% in the indoor unit 102, and then, is returned to the second compressor 114. Also, when the first and second indoor units 102*a* and 102*b* are employed as shown in FIG. 12, the first selector valve 8 is closed and the second selector valve 10 is opened, so that a refrigerant, having passed through the second expansion valve 26*b*, is used to carry out a partial-load compression capacity cooling operation of 60% in the second indoor unit 102*b*, and then, is returned to the second compressor 114.

Turning to FIG. 20, after completing the step S20, the control unit 140 determines whether the stabilizer 150 is operated or not to detect abnormal operation at step S30. If the abnormal operation is detected, a stop-operation mode is selected at step S40. Conversely, if no abnormal operation is detected, the starting-operation is ended, and a normal operation mode is selected at step S50.

Figure 24:
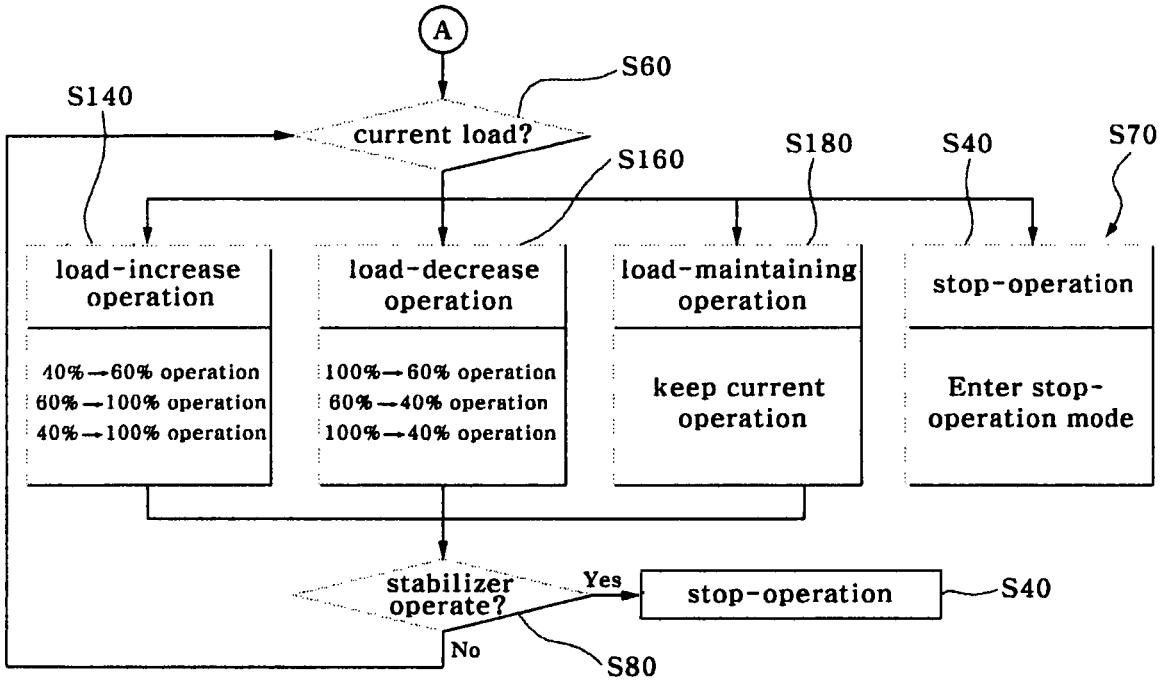
FIG. 24 is a flow chart illustrating a normal operation control procedure in accordance with the present invention.

To carry out the normal operation mode, as shown in FIG. 24, first, the control unit 140 determines a compression load of the first and second compressors 112 and 114 based on the load capacity of the indoor units 102, 102*a* and 102*b* at step S60. Then, the control unit 140 selects any one normal operation mode from among a load-increase operation, a load-decrease operation, a load-maintaining operation, and a stop-operation at step S70.

Figure 25:
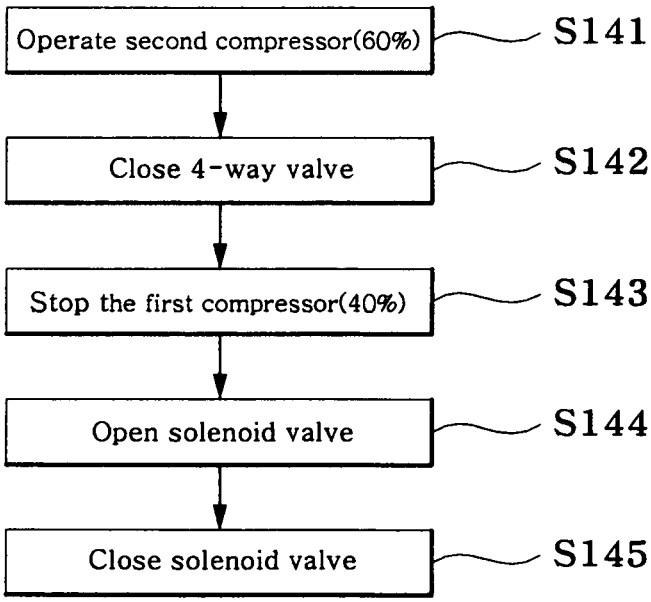
FIG. 25 is a flow chart illustrating a control procedure for a compression capacity increase from 40% to 60% in accordance with the present invention.

For example, if a load-increase operation step S1140 for increasing the lowest load compression capacity of 40% to the middle load compression capacity of 60% is selected at the step S70, as shown in FIG. 25, the second compressor 114 is operated (ON) at step S141, in a state wherein the first compressor 112 is operating.

Then, the direction-switching member 122 is closed (OFF) to connect the second discharge pipe 120 to the condenser 128 at step S142, and subsequently, the first compressor 112 is stopped (OFF) at step S143.

After that, the solenoid valve 124 is opened (ON) to connect the first discharge pipe 118 to the low-pressure connection pipe 116 so that the entrance and exit ends of the first compressor 112 have an equalized low-pressure at step 144. After the lapse of a predetermined time, the solenoid valve 124 is closed (OFF) at step S145.

Figure 26:
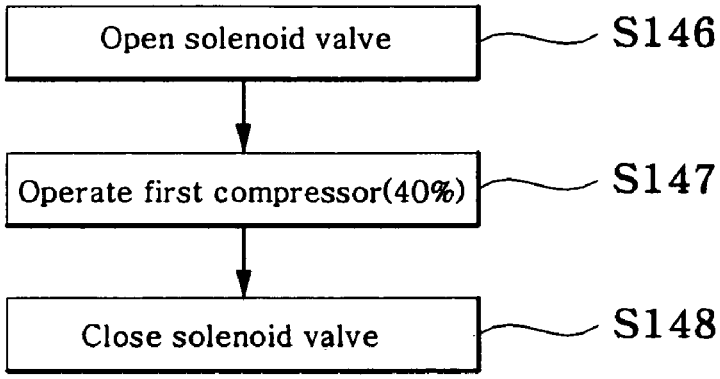
FIG. 26 is a flow chart illustrating a control procedure for a compression capacity increase from 60% to 100% in accordance with the present invention.

Referring to FIG. 26, if the load-increase operation step S140, selected at the step S70, is to increase the middle load compression capacity of 60% to the highest load compression capacity of 100%, the solenoid valve 124 is opened (ON) during operation of the second compressor 114 to connect the first discharge pipe 118 to the low-pressure connection pipe 116, so that the entrance and exit ends of the first compressor are affected by an equalized low-pressure at step S146.

Then, the first compressor 112 is operated (ON) at step S147, and then, the solenoid valve 124 is closed (OFF) at step S148.

Figure 27:
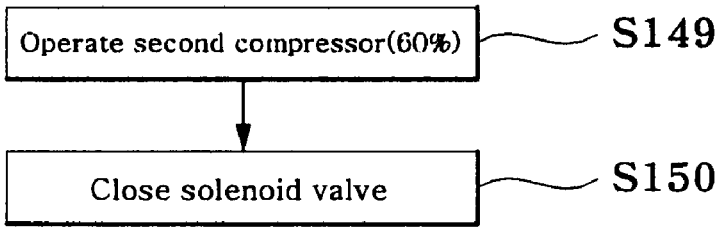
FIG. 27 is a flow chart illustrating a control procedure for a compression capacity increase from 40% to 100% in accordance with the present invention.

Referring to FIG. 27, if the load-increase operation step S140, selected at the step S70, is to increase the lowest load compression capacity of 40% to the highest load compression capacity of 100%, the second compressor 114 is operated (ON) at step S149, in a state wherein the first compressor 112 is operating, and then, the direction-switching member 122 is closed (OFF) to connect the second discharge pipe 120 to the condenser 128 at step S150.

Figure 28:
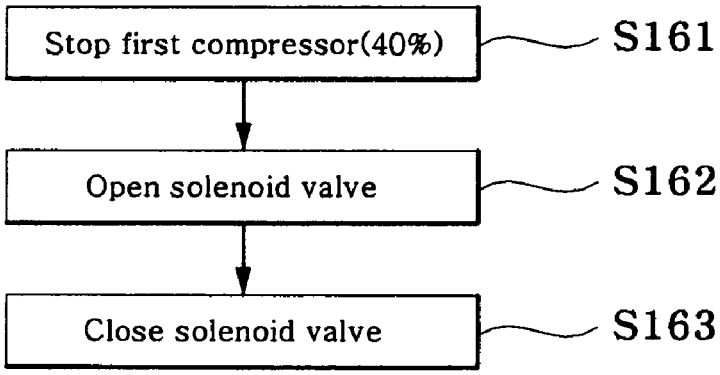
FIG. 28 is a flow chart illustrating a control procedure for a compression capacity decrease from 100% to 60% in accordance with the present invention.

If a load-decrease operation step S160 for decreasing the highest load compression capacity of 100% to the middle load compression capacity of 60% is selected at the step S70 as shown in FIG. 28, only the first compressor 112 is stopped (OFF) at step S161 in a state wherein the second compressor 114 is still operating.

Subsequently, the solenoid valve 124 is opened (ON) to connect the first discharge pipe 118 to the low-pressure connection pipe 116 so that the entrance and exit ends of the first compressor 112 are affected by an equalized low-pressure at step S162, and then, the solenoid valve 124 is closed (OFF) at step S163.

Figure 29:
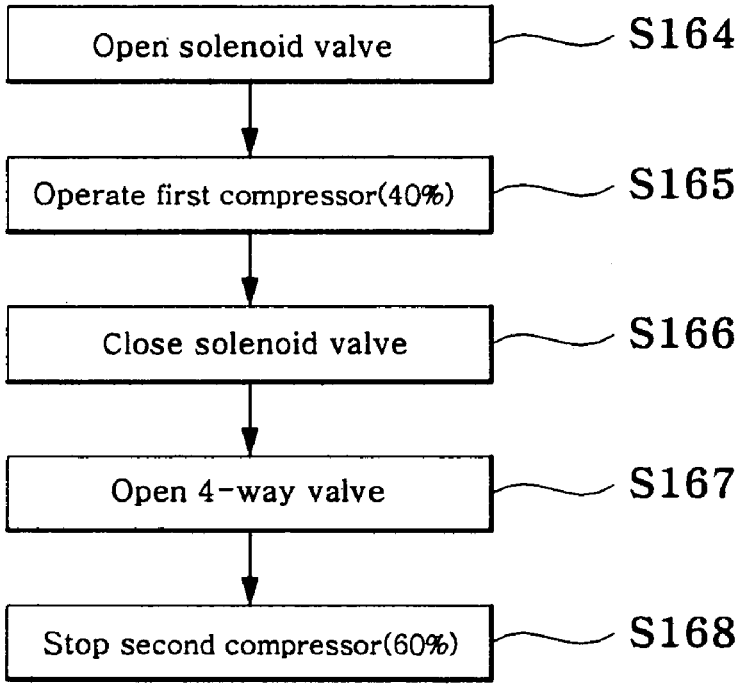
FIG. 29 is a flow chart illustrating a control procedure for a compression capacity decrease from 60% to 40% in accordance with the present invention.

Referring to FIG. 29, if the load-decrease operation step S160, selected at the step S70, is to decrease the middle load compression capacity of 60% to the lowest load compression capacity of 40%, the solenoid valve 124 is opened (ON) during operation of the second compressor 114 to connect the first discharge pipe 118 to the low-pressure connection pipe 116, so that the entrance and exit ends of the first compressor 112 are affected by an equalized low-pressure at step S164.

Subsequently, the first compressor 112 is operated at step 165, and then, the solenoid valve 124 is closed (OFF) at step S166.

After that, the direction-switching member 122 is opened (ON) to connect the second discharge pipe 120 to the low-pressure connection pipe 116 via the branch pipe 116*a* or to directly connect the second discharge pipe 120 to the low-pressure connection pipe 116*b*, so that the entrance and exit ends of the second compressor 114 are affected by an equalized low-pressure at step S167. Then, the second compressor 114 is stopped (OFF) at step S168.

Figure 30:
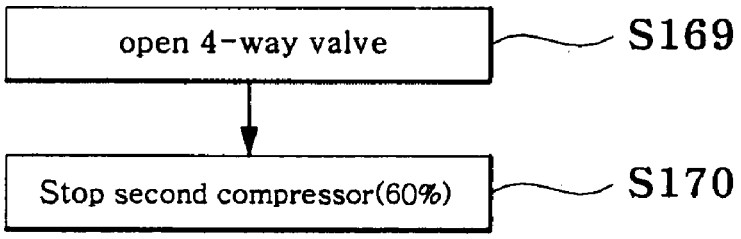
FIG. 30 is a flow chart illustrating a control procedure for a compression capacity decrease from 100% to 40% in accordance with the present invention.

Referring to FIG. 30, if the load-decrease operation step S160, selected at the step S70, is to decrease the highest load compression capacity of 100% to the lowest load compression capacity of 40%, the direction-switching member 122 is opened (ON) during operation of the first and second compressors 112 and 114 to connect the second discharge pipe 120 to the low-pressure connection pipe 116 via the branch pipe 116*a* or to directly connect the second discharge pipe 120 to the low-pressure connection pipe 116*b*, so that the entrance and exit ends of the second compressor 114 are affected by an equalized low-pressure at step S169, and subsequently, the second compressor 114 is stopped (OFF) at step S170.

The method for controlling the capacity of the air conditioner according to the present invention is equally applicable to the first to third embodiments. Although the first to third embodiments are slightly different from each other in configuration, i.e. whether the solenoid valve 124 of the bypass circuit C is connected to the low-pressure connection pipe 106 directly or via the direction-switching member 122, these embodiments are essentially identical to each other from several viewpoints, i.e. that the first and second compressors 112 and 114 are equalized in pressure and their load-increase operation, load-decrease operation, load-maintaining operation, and stop-operation as stated above are identical to each other.

As shown in FIG. 24, after completing step S70, the control unit 140 determines whether the stabilizer 150 is operated or not to detect abnormal operation at step S80. If the abnormal operation is detected, the stop-operation step S40 is selected. Conversely, if no abnormal operation is detected, the normal operation mode is continued at step S80.

Figure 31:
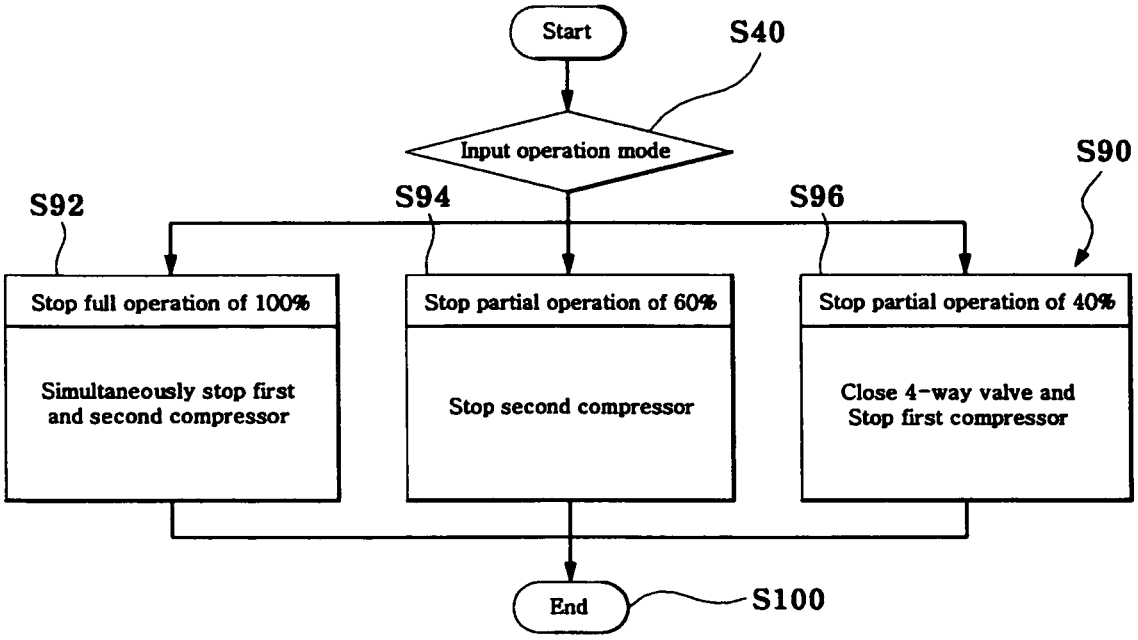
FIG. 31 is a flow chart illustrating a stop operation control procedure in accordance with the present invention.

Meanwhile, as shown in FIG. 31, if the control unit 140 receives a stop signal from the signal input unit 142 or the control unit 140 determines the operation of the stabilizer 150 to detect abnormal operation in step S40, one or both of the first and second compressors are selectively stopped at step S90. In FIG. 31, step S92 is to stop the highest load compression capacity operation of 100%, and step S94 is to stop the middle load compression capacity operation of 60%.

In particular, in step S96 for stopping the lowest load compression capacity operation of 40%, the direction-switching member 122 is closed (OFF) to connect the second discharge pipe 120 to the condenser 128. After that, the first compressor 112 is stopped.

As stated above, the compression capacities of 40% and 60% of the first and second compressors 112 and 114 are merely one example, and admittedly, the compression capacity ratio of the compressors is variable as occasion demands.

Figure 32:
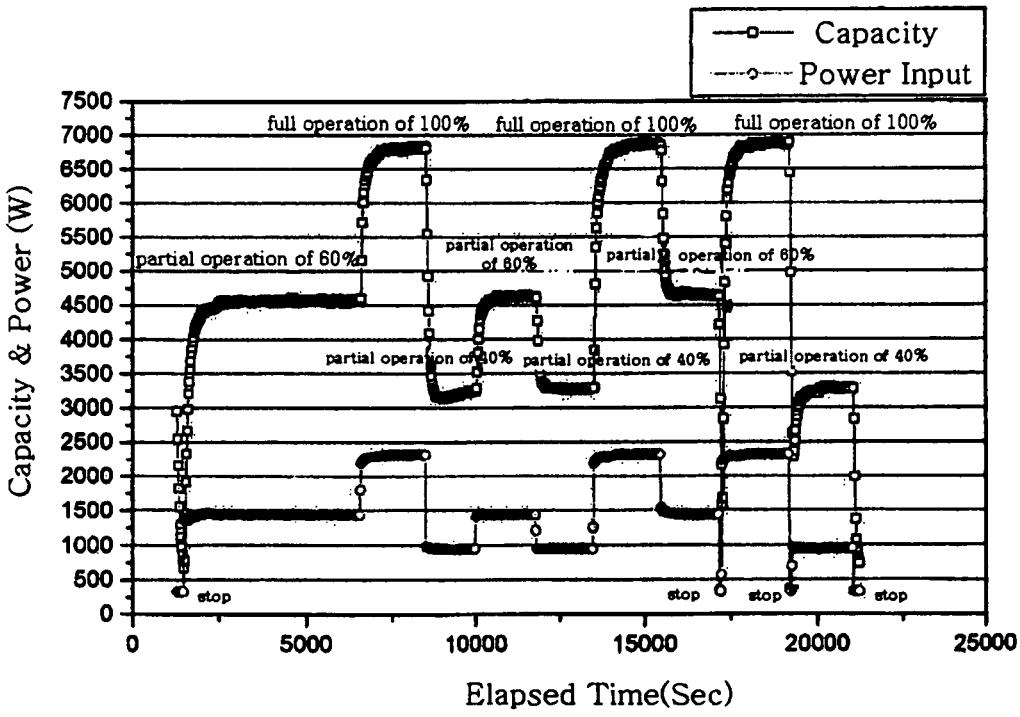
FIG. 32 is a graph illustrating variations in cooling capacity and electricity consumption under different operational conditions in accordance with the present invention.

FIG. 32 is a graph illustrating variations in cooling capacity and electricity consumption under different operation conditions in accordance with the present invention. The cooling capacity and electricity consumption are represented based on the different compression capacity operations of 100%, 60%, and 40% in accordance with input power.

As is apparent from the above description, the present invention provides an apparatus for controlling the capacity of an air conditioner having a pair of first and second compressors, in which a 3-way or 4-way direction-switching member and a low-pressure equalizing solenoid valve are provided at a refrigerant path of the air conditioner so that the compression capacity of the air conditioner is adjusted into three stages of 100%, 60%, and 40% using the first and second compressors to enable easy variable-capacity operation, and a control method using the same. With the capacity control apparatus and method, it is possible to considerably reduce energy consumption and to prevent wear of the first and second compressors via a rapid compensation of a pressure unbalance between both the first and second compressors.

Further, according to the present invention, under any operating condition, it is possible to prevent a liquid backflow phenomenon from occurring when starting operation of the compressors, resulting in an improvement in the reliability and operation efficiency of the compressors.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for controlling the capacity of an air conditioner of a continuous variable-capacity-type, the air conditioner having a pair of first and second compressors and at least one indoor unit, the apparatus comprising:

first and second suction pipes used to diverge a refrigerant that is delivered from the indoor unit via a delivery pipe in order to introduce the refrigerant into the first and second compressors, respectively;

first and second discharge pipes used to supply the refrigerant, compressed in the first and second compressors, into a condenser; and a bypass circuit used to connect both the first and second discharge pipes to the delivery pipe in order to equalize a high-pressure that is applied to exit ends of the first and second compressors to a low-pressure that is applied to entrance ends of the compressors, wherein the bypass circuit includes:

a low-pressure connection pipe used to connect the first discharge pipe to the delivery pipe to equalize the high-pressure of the exit end of the first compressor to the low-pressure;

a solenoid valve provided at the low-pressure connection pipe to control the delivery of the refrigerant;

a branch pipe used to connect the second discharge pipe to the low-pressure connection pipe; and a direction-switching member mounted over both the second discharge pipe and the branch pipe and adapted to be opened and closed to selectively allow the passage of the refrigerant, in order to equalize the high-pressure of the exit end of the second compressor to the low-pressure.

2. The apparatus as set forth in claim 1, further comprising: a check valve to prevent backflow of the refrigerant from the second discharge pipe into the first discharge pipe.

3. The apparatus as set forth in claim 1, further comprising:

a control unit provided to individually control the first and second compressors, the direction-switching member, the solenoid valve, and a stabilizer; and a signal input unit used to input control signals into the control unit.

4. The apparatus as set forth in claim 1, wherein the direction-switching member takes the form of a 3-way control valve or 4-way control valve to individually open and close both the second discharge pipe and the branch pipe.

5. An apparatus for controlling the capacity of an air conditioner of a continuous variable-capacity-type, the air conditioner having a pair of first and second compressors and at least one indoor unit, the apparatus comprising:

first and second suction pipes used to diverge a refrigerant that is delivered from the indoor unit via a delivery pipe in order to introduce the refrigerant into the first and second compressors, respectively;

first and second discharge pipes used to supply the refrigerant, compressed in the first and second compressors, into a condenser; and a bypass circuit used to connect both the first and second discharge pipes to the delivery pipe in order to equalize a high-pressure that is applied to exit ends of the first and second compressors to a low-pressure that is applied to entrance ends of the compressors, wherein the bypass circuit includes:

a low-pressure pipe used to connect the first and second discharge pipes to the delivery pipe to selectively equalize the pressure of the refrigerant passing through the first and second discharge pipes;

a solenoid valve provided at the low-pressure pipe to control the delivery of the refrigerant, in order to equalize the pressure of the refrigerant passing through the first discharge pipe to the pressure of the refrigerant passing through the delivery pipe; and a direction-switching member mounted over both the second discharge pipe and the low-pressure pipe and adapted to be opened and closed to selectively connect the first and second discharge pipes to the low-pressure pipe in order to equalize the pressure of the first discharge pipe or the second discharge pipe, or to selectively connect the first and second discharge pipes to a condenser introduction pipe for a selective refrigerant supply.

6. The apparatus as set forth in claim 5, further comprising:

a control unit provided to individually control the first and second compressors, the direction-switching member, the solenoid valve, and a stabilizer; and a signal input unit used to input control signals into the control unit.

7. The apparatus as set forth in claim 5, wherein the direction-switching member takes the form of a 4-way control valve to individually open and close both the second discharge pipe and the low-pressure pipe.

8. The apparatus as set forth in claim 5, wherein, when the first and second compressors are simultaneously operated, the direction-switching member is closed to connect the second discharge pipe to the condenser introduction pipe, and the solenoid valve is closed to connect the first discharge pipe to the condenser introduction pipe via a check valve.

9. The apparatus as set forth in claim 5, wherein the first compressor is operated and the second compressor is stopped, the direction-switching member is opened to connect the second discharge pipe to the low-pressure pipe in order to achieve an equalized pressure at the entrance and exit ends of the second compressor, and the solenoid valve is opened so that a part of the refrigerant passing through the first discharge pipe is delivered into the second discharge pipe via the solenoid valve and the direction-switching member prior to being supplied into the condenser introduction pipe, thereby enabling dispersion in the flow of the refrigerant discharged from the first compressor and achieving a reduction in frictional resistance.

10. The apparatus as set forth in claim 5, wherein, when the first compressor is stopped and the second compressor is operated, the direction-switching member is closed to connect the second discharge pipe to the condenser introduction pipe, and the solenoid valve is opened to connect the first discharge pipe to the low-pressure pipe to achieve an equalized pressure at the entrance and exit ends of the first compressor.

11. The apparatus as set forth in claim 5, further comprising: a check valve to prevent backflow of the refrigerant from the second discharge pipe into the first discharge pipe.

12. A method for controlling an air conditioner of a continuous variable-capacity type, the air conditioner having a pair of first and second compressors and at least one indoor unit, the method comprising:

inputting desired operational information into a signal input unit to allow a control unit to select a desired operation mode;

selectively starting operation of the first and second compressors to perform one of a highest compression capacity operation, a middle compression capacity operation, and a lowest compression capacity operation;

determining whether a stabilizer is operated or not by use of the control unit to detect the presence of abnormal operation, and entering a stop-operation mode if the abnormal operation is detected, or ending the starting-operation and entering a normal operation mode if no abnormal operation is detected;

determining a required compression load of the first and second compressors based on the load capacity of the indoor unit by use of the control unit, and subsequently, selecting any one normal operation mode from among a load-increase operation, a load-decrease operation, a load-maintaining operation, and a stop-operation; determining whether the stabilizer is operated or not to detect the presence of abnormal operation, and entering the stop-operation mode if the abnormal operation is detected, or continuously performing the normal operation mode if no abnormal operation is detected; and stopping the first and second compressors if an operation stop signal is input from the signal input unit into the control unit or if the stop-operation mode is selected as a result of detecting the abnormal operation.

13. The method as set forth in claim 12, wherein the starting of operation of both the first and second compressors to perform the highest compression capacity operation of 100% comprises:

opening a solenoid valve to connect a first discharge pipe to a low-pressure connection pipe to achieve an equalized low pressure, and opening a direction-switching member to connect a second discharge pipe to a branch pipe to achieve an equalized low pressure;

operating the first compressor;

closing the solenoid valve; and operating the second compressor and closing the direction-switching member.

14. The method as set forth in claim 13, wherein, in the starting of operation of both the first and second compressors to perform the highest compression capacity operation of 100%, a first indoor unit of a room air conditioner (RAC) type and a second indoor unit of a package air conditioner (PAC) type are employed so that they are simultaneously operated.

15. The method as set forth in claim 12, wherein the starting of operation of only the first compressor to perform the lowest concentration capacity operation of 40% comprises:

opening a solenoid valve to connect a first discharge pipe to a low-pressure connection pipe to achieve an equalized low-pressure, and opening a direction-switching member to connect a second discharge pipe to a branch pipe to achieve an equalized low-pressure; operating the first compressor; and closing the solenoid valve.

16. The method as set forth in claim 15, wherein, in the starting of operation of only the first compressor to perform the lowest compression capacity operation of 40%, a first indoor unit of a room air conditioner (RAC) type and a second indoor unit of a package air conditioner (PAC) type are employed so that only the first indoor unit, having a capacity lower than that of the second indoor unit, is operated.

17. The method as set forth in claim 12, wherein the starting of operation of only the second compressor to perform the middle compression capacity operation of 60% comprises:

opening a direction-switching member to connect a second discharge pipe to a branch pipe to achieve an equalized low-pressure;

closing the direction-switching member to connect the second discharge pipe to a condenser; and operating only the second compressor.

18. The method as set forth in claim 17, wherein, in the starting of operation of only the second compressor to perform the middle compression capacity operation of 60%, a first indoor unit of a room air conditioner (RAC) type and a second indoor unit of a package air conditioner (PAC) type are employed so that only the second indoor unit, having a capacity higher than that of the first indoor unit, is operated.

19. The method as set forth in claim 12, wherein the selection of the normal operation mode for increasing the lowest load compression capacity of 40% to the middle load compression capacity of 60% comprises:

opening the second compressor in a state wherein the first compressor is operating;

closing the direction-switching member to connect a second discharge pipe to a condenser;

stopping the first compressor; and opening a solenoid valve to connect a first discharge pipe to a low-pressure connection pipe to equalize the pressure of the first discharge pipe to a low-pressure, and after the lapse of a predetermined time, closing the solenoid valve.

20. The method as set forth in claim 12, wherein the selection of the normal operation mode for increasing the middle load compression capacity of 60% to the highest load compression capacity of 100% comprises:

opening the solenoid valve during operation of the second compressor to connect a first discharge pipe to a low-pressure connection pipe to achieve an equalized low-pressure;

operating the first compressor; and closing the solenoid valve.

21. The method as set forth in claim 12, wherein the selection of the normal operation mode for increasing the lowest load compression capacity of 40% to the highest load compression capacity of 100% comprises:

opening the second compressor in a state wherein the first compressor is operating; and closing a direction-switching member to connect a second discharge pipe to a condenser.

22. The method as set forth in claim 12, wherein the selection of the normal operation mode for decreasing the highest load compression capacity of 100% to the middle load compression capacity of 60% comprises:

stopping the first compressor in a state wherein the second compressor is still operating;

opening a solenoid valve to connect a first discharge pipe to a low-pressure connection pipe to achieve an equalized low-pressure; and closing the solenoid valve.

23. The method as set forth in claim 12, wherein the selection of the normal operation mode for decreasing the middle load compression capacity of 60% to the lowest load compression capacity of 40% comprises:

opening a solenoid valve during operation of the second compressor to connect a first discharge pipe to a low-pressure connection pipe to achieve an equalized low-pressure;

operating the first compressor; closing the a solenoid valve; and opening a direction-switching member to connect a second discharge pipe to a branch pipe to achieve an equalized low-pressure, and subsequently, stopping the second compressor.

24. The method as set forth in claim 12, wherein the selection of the normal operation mode for decreasing the highest load compression capacity of 100% to the lowest load compression capacity of 40% comprises:

opening a direction-switching member during operating of the first and second compressors to connect a second discharge pipe to a branch pipe to achieve an equalized low-pressure; and stopping the second compressor.

25. The method as set forth in claim 12, wherein the selection of the normal operation mode for selectively stopping the first and second compressors to stop the lowest load compression capacity of 40% comprises:

closing a direction-switching member to connect a second discharge pipe to a condenser;

stopping the first compressor.

* * * * *